US012084883B1

(12) United States Patent
Cunerty et al.

(10) Patent No.: US 12,084,883 B1
(45) **Date of Patent: *Sep. 10, 2024**

(54) LIFT ASSEMBLY FOR A SPA COVER

(71) Applicant: 1140398 Ontario Ltd., Mississauga (CA)

(72) Inventors: John Joseph Cunerty, Toronto (CA); Roy Fillmore, Mississauga (CA)

(73) Assignee: 1140298 Ontario Ltd., Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/232,462

(22) Filed: Aug. 10, 2023

Related U.S. Application Data

(63) Continuation of application No. 18/139,420, filed on Apr. 26, 2023, now Pat. No. 11,795,716.

(51) Int. Cl.
*E04H 4/08* (2006.01)

(52) U.S. Cl.
CPC ..... *E04H 4/084* (2013.01)

(58) Field of Classification Search
CPC ..... E04H 4/084
USPC ..... 4/498
See application file for complete search history.

(56) References Cited

U.S. PATENT DOCUMENTS

| | | | |
|---|---|---|---|
| 467,991 | A | 2/1892 | Frederick |
| 566,809 | A | 9/1896 | Strong |
| 1,641,514 | A | 9/1927 | Wiebmer |
| 2,504,319 | A | 4/1950 | Freeman |
| 3,918,108 | A | 11/1975 | Feyerherm |
| 3,954,182 | A | 5/1976 | McEvers |
| 4,163,295 | A | 8/1979 | Schiitz |
| 4,659,084 | A | 4/1987 | Vuick |
| 4,853,985 | A | 8/1989 | Perry |
| 4,991,238 | A | 2/1991 | Forrest |

(Continued)

FOREIGN PATENT DOCUMENTS

| | | |
|---|---|---|
| CA | 2053858 | 9/1991 |
| CA | 2098974 | 12/1994 |

(Continued)

OTHER PUBLICATIONS

Cover-Up! advertisements, 2 pgs., no date given.

(Continued)

*Primary Examiner* — Christine J Skubinna
(74) *Attorney, Agent, or Firm* — BERESKIN & PARR LLP/S.E.N.C.R.L., s.r.l.

(57) ABSTRACT

Described herein are embodiments of a lift assembly for assisting a user to move a spa cover on and/or off of a spa. The lift assembly includes a lever arm mount; a lever arm pivotally coupled to the lever arm mount; a spa cover crossbar coupled to the lever arm; and at least one pneumatic spring. The lever arm is pivotable between a cover closed position and a cover open position and in the cover closed position the pneumatic spring(s) urge the lever arm to rotate toward the cover open position. Optionally, the pneumatic spring(s) may urge the lever arm to also rotate toward the cover closed position. In some examples, the spa cover crossbar is shaped to limit bending and/or twisting thereof. Optionally, the lift assembly may include an overrotation inhibiter to limit the amount the lever arm can rotate away from the cover closed position.

20 Claims, 18 Drawing Sheets

(56) References Cited

U.S. PATENT DOCUMENTS

| | | | |
|---|---|---|---|
| 5,029,740 | A | 7/1991 | Cox |
| 5,039,105 | A | 8/1991 | Ro |
| 5,048,131 | A | 9/1991 | Stephen |
| 5,048,153 | A | 9/1991 | Wall et al. |
| 5,131,102 | A | 7/1992 | Sailey et al. |
| 5,224,636 | A | 7/1993 | Bounds |
| 5,339,494 | A | 8/1994 | Esau |
| 5,367,722 | A | 11/1994 | Pesterfield |
| 5,373,590 | A | 12/1994 | Svae et al. |
| 5,439,226 | A | 8/1995 | Luedtke |
| 5,471,685 | A | 12/1995 | Cross |
| 5,507,044 | A | 4/1996 | Williamson et al. |
| 5,517,703 | A | 5/1996 | Quelette |
| 5,566,403 | A | 10/1996 | Black et al. |
| 5,584,081 | A | 12/1996 | Quelette |
| 5,634,218 | A | 6/1997 | Quelette |
| 5,644,803 | A | 7/1997 | Wilson |
| 5,657,884 | A | 8/1997 | Zilincar, III |
| 5,689,841 | A | 11/1997 | Black et al. |
| 5,745,932 | A | 5/1998 | Barovetto |
| 5,800,291 | A | 9/1998 | Grover |
| 5,819,332 | A | 10/1998 | Perry |
| 5,924,964 | A | 7/1999 | Hayden |
| 5,950,252 | A | 9/1999 | Fettes |
| 5,974,599 | A | 11/1999 | Tudor |
| 5,974,600 | A | 11/1999 | Pucci |
| 5,996,137 | A | 12/1999 | Genova |
| 6,000,071 | A | 12/1999 | Fettes |
| 6,000,072 | A | 12/1999 | LaHay |
| 6,032,305 | A | 3/2000 | Tedrick |
| 6,039,293 | A | 3/2000 | Minet |
| RE36,669 | E | 4/2000 | Zilincar, III |
| 6,093,111 | A | 7/2000 | Senn |
| 6,149,556 | A | 11/2000 | Jordan |
| 6,158,063 | A | 12/2000 | Tudor |
| 6,195,811 | B1 | 3/2001 | Dragovic |
| 6,202,570 | B1 | 3/2001 | Kurtsman |
| 6,381,766 | B1 | 5/2002 | Perry |
| 6,442,799 | B1 | 9/2002 | Duarte |
| 6,565,060 | B2 | 5/2003 | Li et al. |
| 6,595,865 | B2 | 7/2003 | Stitz |
| 6,601,834 | B2 | 8/2003 | Perry |
| 6,718,566 | B1 | 4/2004 | Wilson |
| 6,742,196 | B2 | 6/2004 | LaHay |
| 6,795,984 | B1 | 9/2004 | Brady |
| 6,932,712 | B2 | 8/2005 | Cardosi |
| 6,938,281 | B1 | 9/2005 | Tudor |
| 6,974,043 | B1 | 12/2005 | Lai |
| 6,988,957 | B2 | 1/2006 | Bender |
| 7,461,417 | B2 | 12/2008 | Godbersen |
| 7,666,106 | B1 | 2/2010 | Herbert |
| 7,784,120 | B2 | 8/2010 | Spicer |
| 7,987,538 | B1 | 8/2011 | Kimball |
| 8,516,626 | B2 | 8/2013 | Gardenier et al. |
| 8,590,080 | B1 | 11/2013 | Staresinic |
| 9,181,721 | B2 | 11/2015 | Spicer |
| 9,578,999 | B2 | 2/2017 | Schwartz |
| 9,644,382 | B1 | 5/2017 | Turner |
| 9,708,823 | B2 * | 7/2017 | Cunerty ..... E04H 4/084 |
| 10,207,172 | B2 | 2/2019 | Hillson |
| 10,273,702 | B1 | 4/2019 | Cunerty |
| 10,507,352 | B2 | 12/2019 | Kimura |
| 10,638,630 | B2 | 4/2020 | Roberts |
| 10,662,665 | B2 | 5/2020 | Cunerty |
| 11,078,680 | B2 | 8/2021 | Cunerty et al. |
| 11,103,739 | B2 | 8/2021 | Shaw, Jr. |
| 11,391,054 | B2 | 7/2022 | Cunerty |
| 11,406,862 | B2 | 8/2022 | Downing |
| 2002/0050003 | A1 | 5/2002 | Perry |
| 2003/0150054 | A1 | 8/2003 | Tudor |
| 2004/0055081 | A1 | 3/2004 | Wilson |
| 2004/0143895 | A1 | 7/2004 | Loyd et al. |
| 2007/0017016 | A1 | 1/2007 | Piche |
| 2007/0022524 | A1 | 2/2007 | Duarte et al. |
| 2007/0079434 | A1 | 4/2007 | Pellerin |
| 2007/0107118 | A1 | 5/2007 | Tudor |
| 2007/0209104 | A1 | 9/2007 | Buzzetti et al. |
| 2008/0222791 | A1 | 9/2008 | Godbersen |
| 2008/0244820 | A1 | 10/2008 | Moore |
| 2009/0126097 | A1 | 5/2009 | Kanetis |
| 2010/0186159 | A1 | 7/2010 | Dalickas |
| 2011/0048654 | A1 | 3/2011 | Kolar |
| 2011/0239360 | A1 | 10/2011 | Gramatikopoulos |
| 2013/0117922 | A1 | 5/2013 | Spicer |
| 2014/0123380 | A1 | 5/2014 | Cunerty |
| 2015/0184411 | A1 * | 7/2015 | Muller ..... A63B 69/125 4/496 |
| 2016/0053505 | A1 | 2/2016 | Dose |
| 2016/0123027 | A1 | 5/2016 | Cunerty et al. |

FOREIGN PATENT DOCUMENTS

| | | | |
|---|---|---|---|
| CA | 2155988 | | 5/1996 |
| CA | 2282012 | | 9/1999 |
| CA | 2298306 | | 1/2001 |
| CA | 2421332 | A1 | 9/2003 |
| CA | 2537640 | A1 | 8/2007 |
| CA | 2966668 | A1 | 5/2016 |
| CN | 203487817 | U | 3/2014 |
| EP | 2078811 | A2 | 7/2009 |
| GB | 2578493 | A | 4/2019 |
| GB | 2579903 | A | 10/2019 |
| WO | 9113224 | | 9/1991 |
| WO | 2016074001 | A1 | 5/2016 |

OTHER PUBLICATIONS

Installation Instructions for the Cover-Up!, 4 pgs., no date given.
Cover Caddy advertisement, 1 pg., no date given.
Cover Caddy Assembly & Mounting instructions, 3 pgs., no date given.
Superlift2 Installation Guide, 7 pgs., no date given.
Covermate I advertisement, 2 pgs., no date given.
Installation Instructions for the Covermate I, 4 pgs., no date given.
Covermate II advertisement, 2 pgs., no date given.
Installation Instructions for the Covermaste II, 7 pgs., no date given.
Installation Instructions for the Covermate III, 4 pgs., no date given.
The Cover Valet advertisement, 2 pgs., no date given.
Installation Instructions for the Cover Valet, 3 pgs., no date given.
The Ideal E-Z Lifter advertisement, 2 pgs., no date given.
The Ideal E-Z Lifter Installation Instructions, 4 pgs., no date given.
The Ideal Cover Lift advertisement, 2 pgs., no date given.
The Ideal Cover Lift Installation Instructions, 4 pgs., no date given.
Cover Rock-It advertisement, 1 pg., no date given.
Cover Rock-It Assembly and Installation Instructions, 4 pgs., no date given.
Superlift2 advertisement, 1 pg., no date given.
"Ultralift HM Cover Lifter Hydraulic Mount", Parts List, Byron Originals dated Oct. 1, 2012.

* cited by examiner

LIFT ASSEMBLY FOR A SPA COVER

FIELD

This application relates to the field of lift assemblies for assisting the lifting of spa covers between a cover on position and a cover off position.

INTRODUCTION

The following is not an admission that anything discussed below is part of the prior art or part of the common general knowledge of a person skilled in the art.

A spa, also referred to as a whirlpool or hot tub, is a large vessel for holding a volume of liquid (e.g., water or mud) and one or more user occupants. Typically, a user occupant sits or lies down in the spa while at least partially submerged in the liquid. This may provide a user occupant with, for example relaxation or therapy. In other examples, the spa may be elongated and configured to produce a current to allow a user to swim therein. This type of spa is commonly referred to as a swim spa.

A spa may contain hundreds or even thousands of liters of liquid. Often, the liquid in the spa is heated to a temperature well above ambient, which may require considerable energy consumption. Accordingly, some spas may include an insulated cover, at least in part for preventing the escape of heat from the liquid when the spa is not in use.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, there is provided a lift assembly for assisting a user to move a spa cover off of a spa, the lift assembly comprising:

a lever arm mount;

a lever arm longitudinally extending from a lever arm first end to a lever arm second end, the lever arm pivotally coupled to the lever arm mount at a lever arm pivot joint proximate the lever arm first end, the lever arm pivot joint defining a lever arm pivot axis extending in a forward-rearward direction;

a spa cover crossbar extending from proximate the lever arm second end, the spa cover crossbar extending transversely to the lever arm;

a first and a second linear drivers each having a linear driver first end and a linear driver second end, the linear driver first ends of the first and second linear driver pivotally coupled to the lever arm, the linear driver first end of the first linear driver positioned on a forward side the lever arm, and the linear driver first end of the second linear driver positioned on a rearward side of the lever arm;

wherein, the lever arm is pivotable about the lever arm pivot axis between a cover closed position, and a cover open position; and in the cover closed position the first and second linear driver are operable to urge the lever arm to rotate toward the cover open position.

In accordance with another aspect of this disclosure, which may be used alone or in combination with any other aspects, there is provided a lift assembly for assisting a user to move a spa cover off of a spa, the lift assembly comprising:

a lever arm mount;

a lever arm longitudinally extending from a lever arm first end to a lever arm second end, the lever arm pivotally coupled to the lever arm mount at a lever arm pivot joint proximate the lever arm first end, the lever arm pivot joint defining a lever arm pivot axis extending in a forward-rearward direction;

a spa cover crossbar extending from proximate the lever arm second end, the spa cover crossbar extending transversely to the lever arm;

at least one linear driver, each linear driver of the at least one linear driver having a first linear driver end and a second linear driver end, the first linear driver end of each linear driver of the at least one linear driver pivotally coupled to the lever arm; and an overrotation inhibiter having a forward plate extending from a forward side of the lever arm;

a rearward plate extending from a rearward side of the lever arm; and a contact plate extending between the forward plate and the rearward plate wherein, the lever arm is pivotable about the lever arm pivot axis between a cover closed position and a cover open position;

in the cover closed position, each linear driver of the at least one linear driver is operable to urge the lever arm to rotate toward the cover open position; and in the cover open position, the contact plate abuts the lever arm mount to limit rotation of the lever arm away from the cover closed position.

In accordance with another aspect of this disclosure, which may be used alone or in combination with any other aspects, there is provided a lift assembly for assisting a user to move a spa cover of a spa, the lift assembly comprising:

a first lever arm mount;

a second lever arm mount;

a first lever arm longitudinally extending from a first lever arm first end to a first lever arm second end, the first lever arm pivotally coupled to the first lever arm mount at a first lever arm pivot joint proximate the first lever arm first end, the first lever arm rotatable relative to the first lever arm mount at the first lever arm pivot joint, the first lever arm pivot joint defining a lever arm pivot axis extending in a forward-rearward direction;

a second lever arm longitudinally extending from a second lever arm first end to a second lever arm second end, the second lever arm pivotally coupled to the second lever arm mount at a second lever arm pivot joint proximate the second lever arm first end, the second lever arm rotatable relative to the second lever arm mount at the second lever arm pivot joint;

a spa cover crossbar extending from proximate the first lever arm second end to proximate the second lever arm second end, the spa cover crossbar extending transversely to the first lever arm and the second lever arm, the spa cover crossbar having an outer surface defining a cross-sectional shape of the spa cover crossbar, and at least a portion the cross-sectional shape of at least a portion of the spa cover crossbar having a convexly curved portion, the spa cover crossbar having at least two crossbar portions telescopically connected to each other, the at least two crossbar portions slidable relative to each other from a first position in which the spa cover crossbar has a first length in the forward-rearward direction to a second position in which the spa cover crossbar has a second length in the forward-rearward direction, wherein the second length is greater than the first length, a first crossbar portion of the at least two crossbar portions having a bore to telescopically receive an end of a second crossbar portion of the at least two crossbar portions, the bore of the first crossbar portion having a bore cross-sectional shape;

the end of the second crossbar portion having a second crossbar portion end cross-sectional shape;

wherein when the end of the second crossbar portion is received by the bore of the first crossbar portion, the bore cross-sectional shape and the second crossbar portion end cross-sectional shape together inhibit rotation of the first crossbar portion relative to the second crossbar portion, wherein, the first lever arm and the second lever arm are pivotable about the lever arm pivot axis between a cover closed position, and a cover open position; and in the cover closed position each linear driver of the at least one linear driver urges the lever arm to rotate toward the cover open position.

These and other aspects and features of various embodiments will be described in greater detail below.

DRAWINGS

For a better understanding of the described embodiments and to show more clearly how they may be carried into effect, reference will now be made, by way of example, to the accompanying drawings in which.

Figure 1:
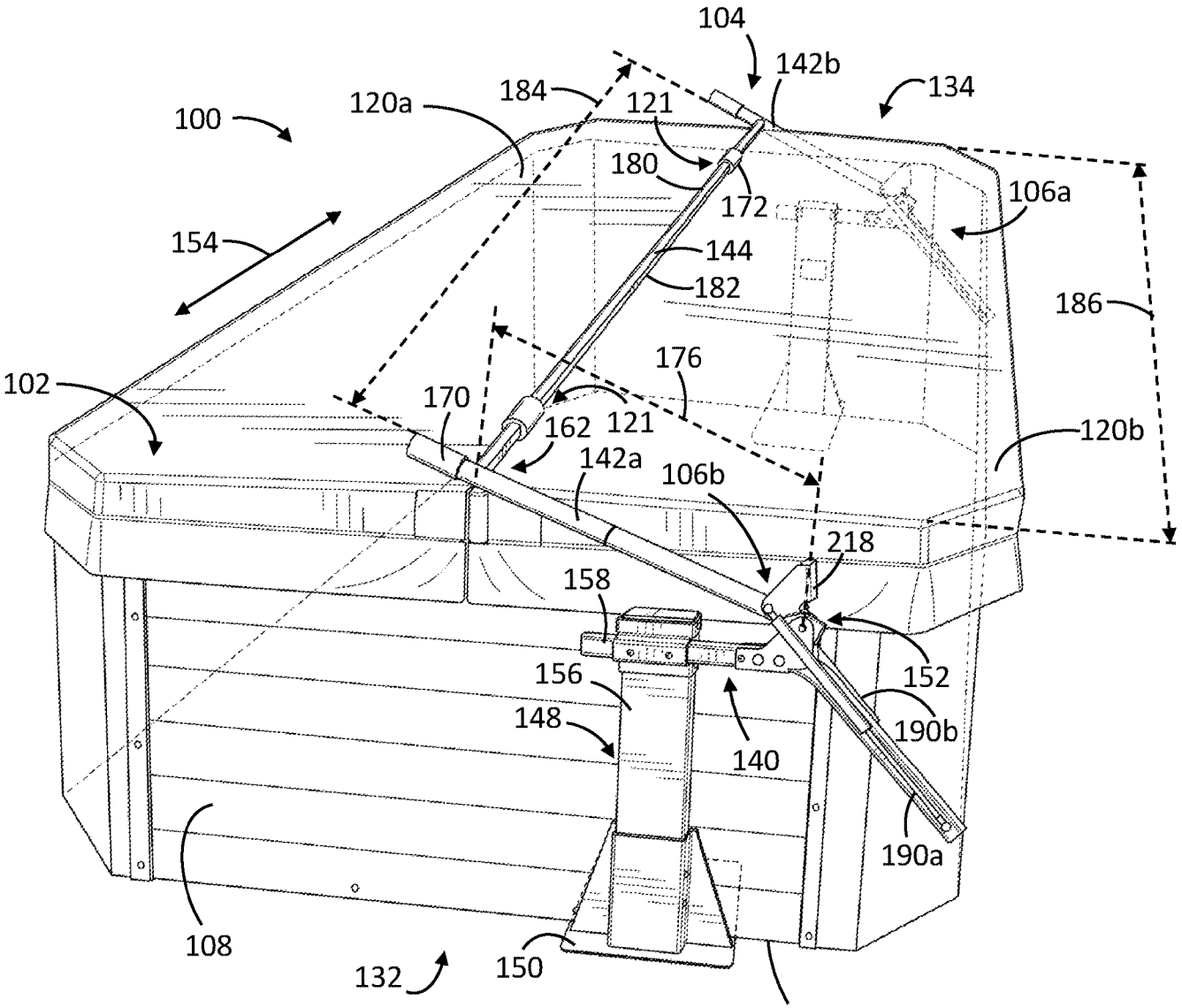
FIG. 1 is a perspective view of a spa equipped with a spa cover and a lift assembly for assisting a user to move the spa cover off of the spa, the spa cover is shown in a cover on position.

The drawings, described below, are provided for purposes of illustration, and not of limitation, of the aspects and features of various examples of embodiments described herein. For simplicity and clarity of illustration, elements shown in the drawings have not necessarily been drawn to scale. The dimensions of some of the elements may be exaggerated relative to other elements for clarity. It will be appreciated that for simplicity and clarity of illustration, where considered appropriate, reference numerals may be repeated among the drawings to indicate corresponding or analogous elements or steps.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

General Description of a Spa

Figure 2:
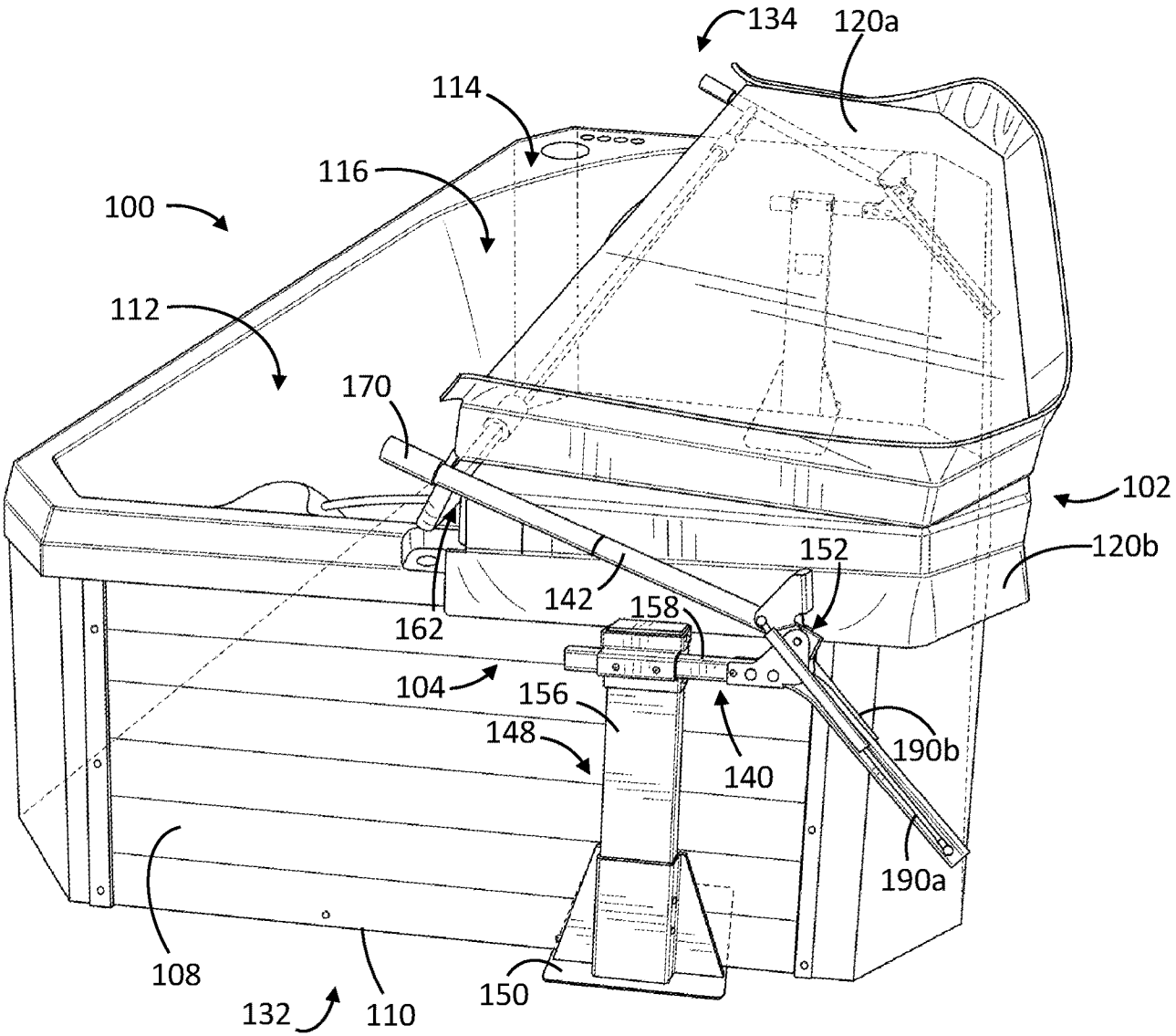
FIG. 2 is a perspective view of the spa of FIG. 1 with the spa cover folded over a spa cover crossbar of the lift assembly.
Figure 3:
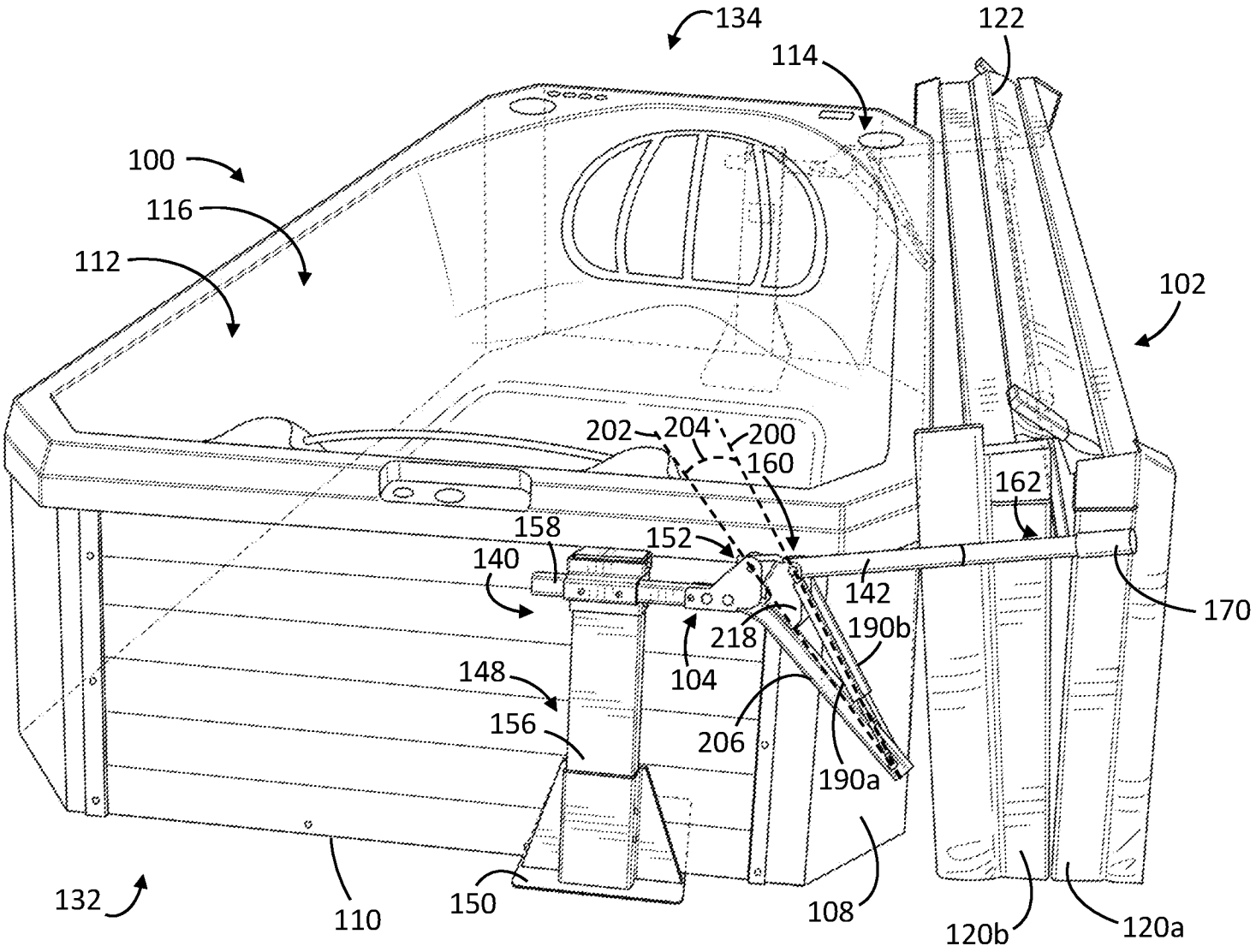
FIG. 3 is a perspective view of the spa of FIG. 1, the spa cover is shown in a cover off position.

FIGS. 1-3 show an example of a spa 100 (also referred to as a hot tub or a whirlpool). In the example illustrated, the spa 100 is a swim spa. As shown, the spa 100 may include a spa cover 102 which may be mounted to a lifting assembly 104. The lifting assembly 104 may assist a user when moving the spa cover 102 on and/or off the spa 100. It may be desirable to have a lifting assembly 104 to assist a user to move the spa cover 102 as the spa cover 102 may be heavy (swim spa covers can weigh over 100 lbs) and may be awkward to maneuver. While the drawings show an example of a lifting assembly 104 in association with a swim spa, it is to be understood that the exemplary lifting assemblies 104 described herein may be used on other types of spas.

As shown in FIG. 3, the spa 100 includes sidewalls 108 and a bottom 110, which collectively define an interior chamber 112 for containing a volume of water and one or more user occupants. The spa 100 includes an upper end 114 that defines an upper opening 116 for user entry into and exit from the interior chamber 112. In the illustrated example, the sidewalls 108 and the bottom 110 define a substantially rectangular footprint with chamfered corners. In other embodiments, the sidewalls 108 and the bottom 110 may define a circular, triangular or other regular or irregularly shaped footprint.

As shown in the illustrated example, the interior chamber 112 may include an inner tub 118 positioned above the bottom 110 and between the sidewalls 108. The inner tub 118 may be contoured to provide seating for user occupants of the spa 100, as is known in the art. Further, the spa 100 may include one or more jets positioned to direct air and/or water into the spa interior chamber 112 below a water level inside the spa 100. Optionally, when configured as a swim spa, the one or more jets may produce a current within the inner tub 118 for a user to swim against. It will be appreciated that in some embodiments, the inner tub 118 may be integrally formed with one or more (or all) of the sidewalls 108 and the bottom 110.

As shown in FIGS. 1 and 2, the spa cover 102 is positionable over the spa upper end 114 to close at least a portion of (or all of) the spa upper opening 116. In the illustrated example, the spa cover 102 is shown having a size and shape that covers an entirety of the spa upper end 114. In some embodiments, as shown, the spa cover 102 may be foldable. For example, the spa cover 102 may include two or more portions 120 joined at a seam 122, and may be foldable over the seam 122. In the illustrated example, the spa cover 102 includes two spa cover portions 120 (i.e., 120*a*, 120*b*) of substantially equal size and shape. As seen in the transition from FIG. 1 to FIG. 2, spa cover portion 120*a* can be folded about seam 122 over spa cover portion 120*b*. When folded, the spa cover 102 may have a more compact configuration that is easier to store (as shown in FIG. 3).

In alternative embodiments, one or more (or all of) cover portions 120 may be differently sized and/or shaped to cover differently sized and/or shaped portions of the spa upper end 114. In some embodiments, the spa 100 may include two discrete covers 102, which are not connected by a seam 122. In some embodiments, the spa 100 may include a spa cover 102 having only one spa cover portion 120, which is not foldable.

With reference to FIGS. 1-3, the spa cover 102 may be movable between a cover on position (shown by example in FIG. 1), in which the spa cover 102 rests on the spa upper end 114 (overlying at least a portion of the spa upper opening 116), and a cover off position (shown by example in FIG. 3). In the cover off position, the spa cover 102 may be clear of the spa upper opening 116. For example, the spa cover 102 may be located laterally outwardly of the spa 100, as shown in FIG. 3. As shown by example in FIGS. 1-3, where the spa cover 102 is foldable, the spa cover 102 may be folded before moving the spa cover 102 to the cover off position, and the spa cover 102 may be unfolded in the cover on position.

In the cover on position, the spa cover 102 may seal the interior chamber 112, and the water contained therein, from the external environment to mitigate entry of dirt/debris and loss of heat. A spa 100 may be sized to hold hundreds or even thousands of liters of water (or other liquid, e.g., mud). Further, the water inside the spa 100 may be heated to temperatures of up to 100° F. or higher. The energy consumption required to heat such volumes of water is significant. Therefore, the spa cover 102 may be configured to provide insulation against heat loss. In this way, the spa cover 102 may reduce the time required to heat the water inside interior chamber 112 and may conserve the water temperature for future usage. In the illustrated example, the spa cover 102 may be from several inches to a foot or more thick (e.g., 4-20 inches) to provide the desired insulating properties. Further, the spa cover 102 may weigh from tens of pounds to a hundred pounds or more (e.g., 20-150 lbs). The size and weight of the spa cover 102 may make moving the spa cover 102 between the cover on and off positions difficult for a user, if not assisted.

General Description of a Lift Assembly

Referring to FIGS. 1-3, the spa cover 102 may be connected to a lift assembly 104. The lift assembly 104 is user operable for selectively removing and replacing the spa cover 102 over the spa upper opening 116. The lift assembly 104 may reduce or eliminate the force required from a user to move the spa cover 102 from the cover on position to the cover off position. Optionally, the lift assembly 104 may reduce or eliminate the force required from a user to move the spa cover 102 from the cover off position to the cover on position. In some examples, the lift assembly 104 may reduce or eliminate the force required from a user to move the spa cover 102 from the cover on position to the cover off position and from the cover off position to the cover on position. For example, the lift assembly 104 may supplement user-applied force to the spa cover 102 to reduce the effective weight of the spa cover 102 for a user moving the spa cover 102 between the cover on and off positions.

In the illustrated example, the lift assembly 104 has an active (i.e., reduces or eliminates the effective weight of the spa cover for the user) spa cover mount 106 (i.e., 106*a*, 106*b*) at each end thereof. As shown, the first active mount 106*a* may be positioned proximate spa front end 132, and the second active mount 106*b* may be positioned proximate spa rear end 134. As shown, both active mounts 106*a*, 106*b* may act upon the same spa cover 102. This may provide balance in the application of force by the lift assembly 104 to the spa cover 102, which may mitigate the spa cover 102 twisting.

In alternative embodiments, only one active spa cover mount 106 may be positioned at one of spa front end 132 and spa rear end 134. That is, a lift assembly 104 may have a single active spa cover mount 106 that is solely responsible for supplementing user applied force to move the spa cover 102, while a simple linkage/support (i.e., non-active mount, not shown) may be provided on an opposite end of the spa 100.

Figure 12:
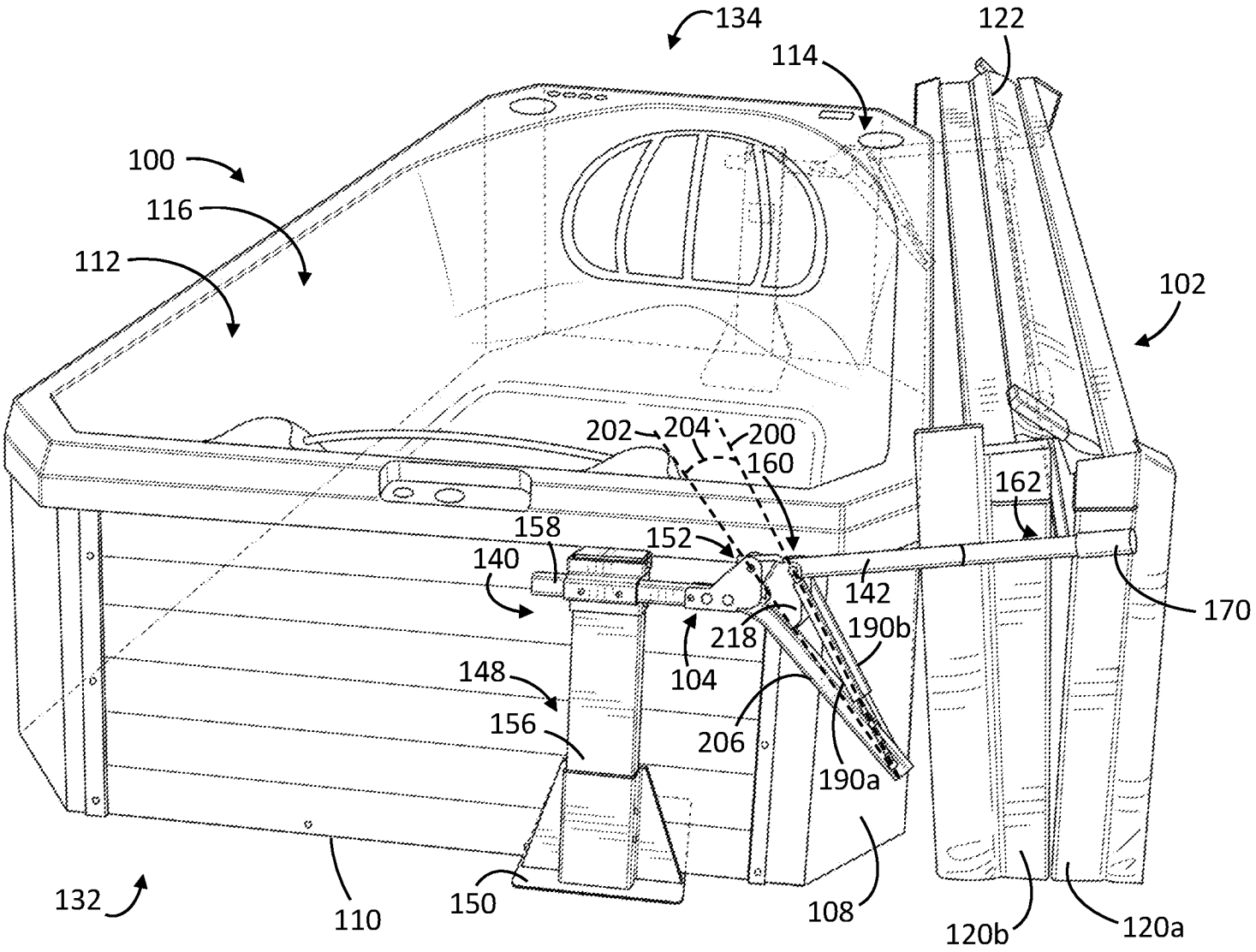
FIG. 12 is a perspective view of a spa equipped with a spa cover and a second example of a lift assembly for assisting a user to move the spa cover off of the spa, the spa cover is shown in a cover off position.

As shown in FIGS. 1-3, the lift assembly 104 may include a lever arm mount 140, a lever arm 142, a spa cover crossbar 144, and at least one linear driver 190. Linear driver 190 may be a passive linear driver (e.g., that exerts force based on its degree of extension), such as a pneumatic spring or coil spring, or an active linear driver (e.g., that exerts force based motor activation) such as an electrically powered linear actuator. A passive linear driver may have a relatively lower cost, and may not require any power source (e.g., battery or electrical connection). An active linear driver may have a relatively higher cost, but may allow for the spa cover 102 to be moved from the cover on position to the cover off position, and vice versa, without any lift assistance from a user (e.g., by simply pressing a button). FIGS. 1-3 show an example of lift assembly 104 having a passive linear driver 190, that is a pneumatic spring. FIG. 12 shows an example of lift assembly 104 having an active linear driver 190 that is a linear actuator.

Lever Arm Mount

As shown in FIGS. 1-3, the lever arm mount 140 may hold at least a portion of the lever arm 142 at a fixed location with respect to the spa 100. In the illustrated example, the lever arm mount 140 includes a ground support leg 148 for holding the lever arm 142 on a ground surface and at a fixed location with respect to the spa 100. In alternative embodiments, the lever arm mount 140 may be directly secured to the spa 100 (e.g., to the sidewall 108) for holding at least a portion of the lever arm 142 at a fixed location with respect to the spa 100. More specifically, the lever arm mount 140 may include a plate that is securable directly to the spa (not shown).

It may be desirable to provide a lever arm mount 140 having a ground support leg 148 so that the position of the lever arm 142 relative to the spa 100 may be readily adjustable. In addition, providing a lever arm mount 140 having a ground support leg 148 allows for the weight of the spa cover 102 supported by the lift assembly 104 to be transferred directly to the ground surface, as opposed to, for example, to the sidewall 108 in examples where the lever arm mount 140 is directly secured to the spa 100.

Further, the ground support leg 148 of the lever arm mount 140 may form a non-destructive rigid support for the lever arm 142. That is, using a ground support leg 148 may avoid drilling any holes into spa 100 (e.g., to accommodate fasteners) to position the lever arm 142 relative to the spa 100.

In the example illustrated, the ground support leg 148 includes a foot 150 (e.g., bearing plate) that extends underneath the spa 100 and that relies upon the weight of spa 100 (particularly when filled with water) to provide an effective rigid connection to spa 100. In other words, the weight of spa 100 upon foot 150 may inhibit the lever arm mount 140 from moving relative to the spa 100 while operating lift assembly 104 to move the spa cover 102 between the cover on and off positions.

In the example illustrated, lever arm mount 140 has a lever arm pivot joint 152 (described in more detail below) where the lever arm mount 140 may be coupled to the lever arm 142. The lever arm pivot joint 152 may be movable in one or more directions (e.g., laterally and/or vertically) relative the foot 150 between at least two positions (e.g., lateral and/or vertical positions), and selectively rigidly connectable to the foot 150 at each position (e.g., using set screw(s)). This can allow for the lifting assembly 104 to be compatible with a wide range of spa configurations (shapes and sizes).

More specifically, in the example shown, the lever arm mount 140 includes an upright support 156 and a lateral positioning arm 158. The upright support 156 may be movable vertically relative to the foot 150 between at least two vertical positions, and rigidly connectable to the foot 150 at each location (e.g., using set screw(s)). In the example shown, the lateral positioning arm 158 may be laterally movable relative to the upright support 156 between at least two lateral positions, and selectively rigidly connectable to upright support 156 at each position (e.g., using set screw(s)). Together, the vertical position of the upright support 156 and the lateral position of the lateral positioning arm 158 may control the vertical and lateral position of the lever arm pivot joint 152. This may permit lever arm pivot joint 152 to be easily positioned to accommodate spas of many sizes and shapes.

Lever Arm

In the example illustrated in FIGS. 1-3, the lever arm 142 extends longitudinally from a lever arm first end 160 to a lever arm second end 162. As shown, the lever arm 142 may be pivotally coupled to the lever arm mount 140 at the lever arm pivot joint 152 proximate the lever arm first end 160. Accordingly, the lever arm 142 may be rotatable relative to the lever arm mount 140 at the lever arm pivot joint 152. As used herein and in the claims, an element is said to be positioned proximate a first end of an object, which has first and second ends, when that element is positioned closer to the first end than to the second end (and vice versa).

Figure 4:
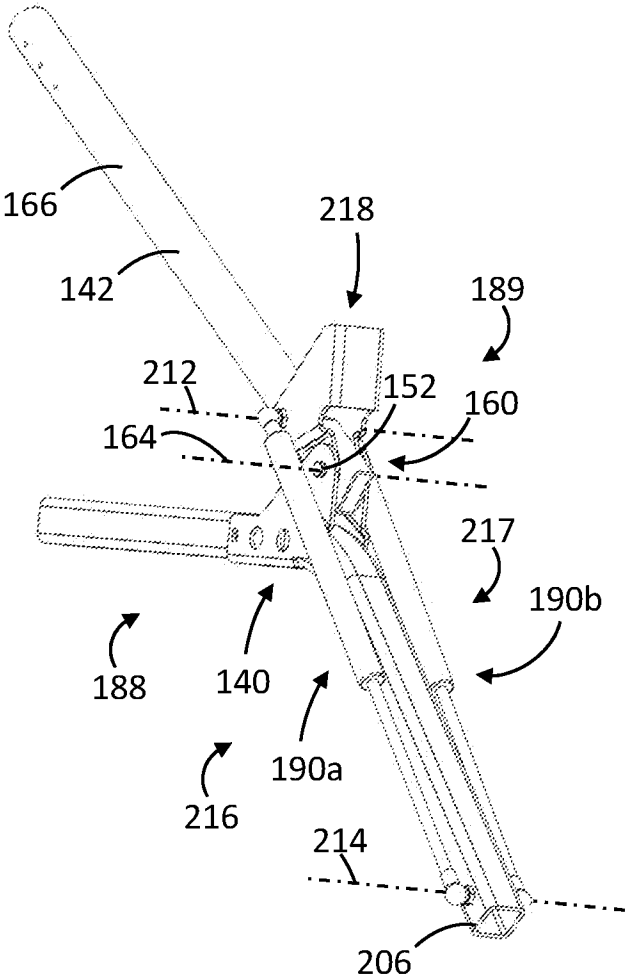
FIG. 4 is a perspective view of a lever arm, a lever arm mount, and first and second pneumatic springs of the lift assembly of FIG. 1.

With reference to FIGS. 1 and 4, the lever arm pivot joint 152 (i.e., where the lever arm 142 is pivotable about the lever arm mount 140) defines a lever arm pivot axis 164 that extends in a forward-rearward direction 154. With reference to FIG. 4, the lever arm 142 may be pivotable about the lever arm pivot axis 164 between a cover closed position (FIG. 1) and a cover open position (FIG. 3).

The lever arm pivot joint 152 may have any design suitable to allow lever arm 142 to rotate relative to lever arm mount 140 between the cover closed and open positions. For example, the lever arm pivot joint 152 may be provided by a hinge that rotatably connects the lever arm 142 to the lever arm mount 140.

The lever arm 142 may rotate any angular distance between the cover closed and open positions. For example, the lever arm 142 may rotate at least 90 degrees (e.g., 90 to 270 degrees). In the illustrated example, lever arm 142 is shown rotating approximately 135 degrees between the cover closed and open positions.

The lever arm first end 160 may be movable (i.e., telescope) relative to the lever arm second end 162 to increase or decrease a length of the lever arm 142. It may be desirable to provide a lever arm 142 having a variable length so that a longitudinal distance 176 between the spa cover crossbar 144 and lever arm pivot axis 164 may be adjustable. This can allow the lever arm 142 to accommodate spa covers of different dimensions. It will be appreciated that in some embodiments, the longitudinal distance 176 between the spa cover crossbar 144 and the lever arm pivot axis 164 may be adjustable without increasing or decreasing the length of the lever arm 142 (e.g., by providing multiple attachment points along the lever arm 142 for the spa cover crossbar 144).

Figure 6:
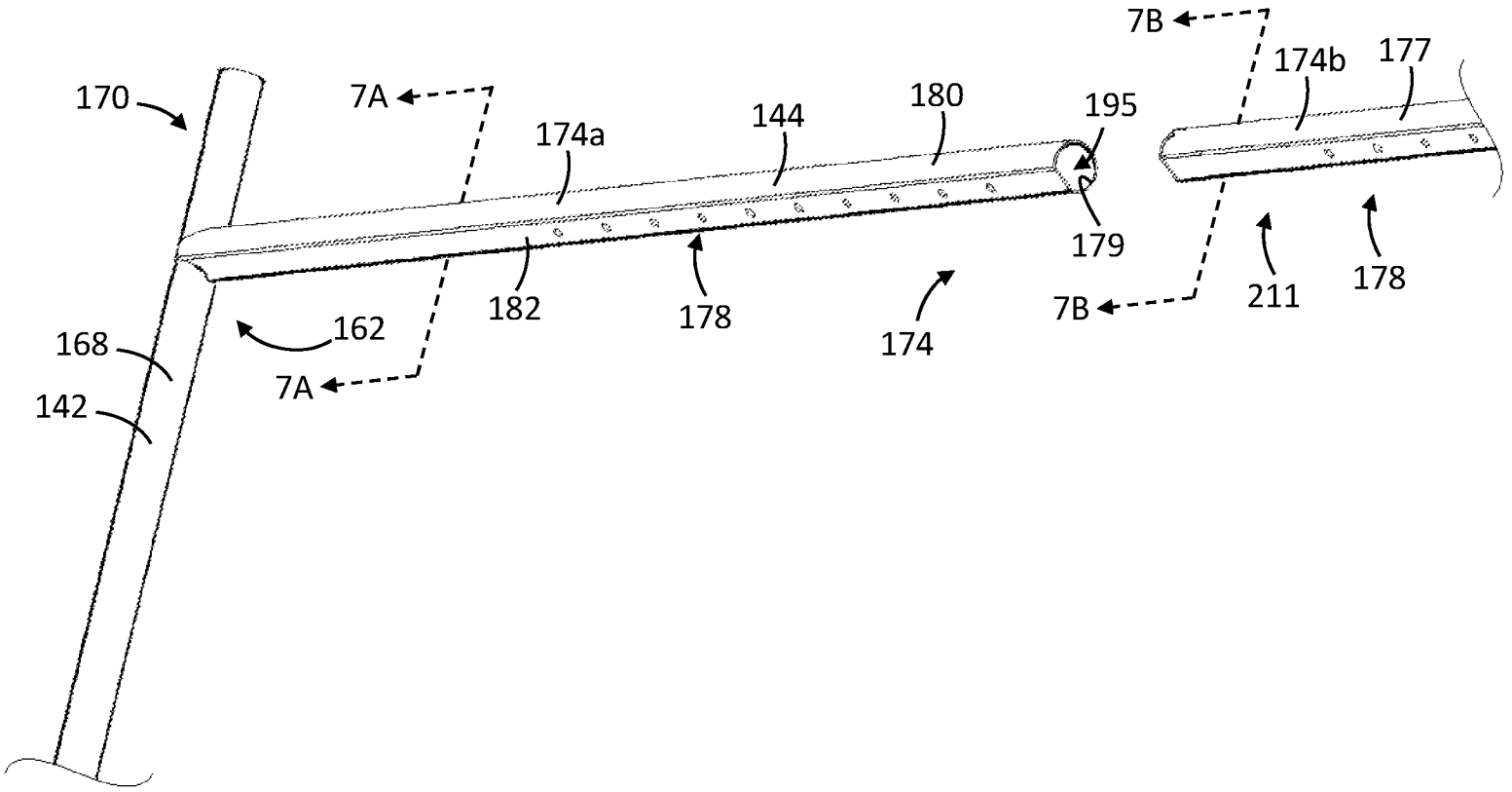
FIG. 6 is a perspective view of a lever arm and a spa cover crossbar of the lift assembly of FIG. 1.

As shown, lever arm second end 162 may be movable relative to the lever arm first end 160 between two or more longitudinal positions, and selectively rigidly connectable to lever arm first end 160 at each longitudinal position. With reference to FIGS. 4 and 6, in the example illustrated, the lever arm 142 has a lever arm first portion 166 having the lever arm first end 160 that is telescopically connected to a lever arm second portion 168 having the lever arm second end 162, and a set screw (not shown) may be inserted to fix the position of lever arm first portion 166 relative to lever arm second portion 168.

In alternative embodiments, lever arm first end 160 may not be movably connected to the lever arm second end 162.

Referring to FIGS. 1-3, in some embodiments, the lever arm 142 may include a handle 170 that a user can grasp to move the lever arm 142 between the cover closed and open positions. As shown, the handle 170 may be connected to the lever arm second end 162 and may extend therefrom away from lever arm pivot axis 164. This allows handle 170 to provide a user with a longer moment arm, whereby the user's mechanical advantage in rotating lever arm 142 is increased and therefore the force required by the user to rotate lever arm 142 may be reduced. In the illustrated example, the handle 170 extends away from the lever arm second end 162 aligned with the lever arm 142 (e.g., normal to the forward-rearward direction 154). In alternative embodiments, the handle 170 may extend from the lever arm 142 in, for example, the forward-rearward direction 154.

Spa Cover Crossbar

Still referring to FIGS. 1-3, as shown, the spa cover crossbar 144 may extend from the lever arm 142 proximate the lever arm second end 162. When in use, the spa cover crossbar 144 supports the spa cover 102. That is, the spa cover crossbar 144 may engage (e.g., carry) the spa cover 102 as the lift assembly 104 changes position, so that movement of the lever arm 142 between the cover closed and open positions translates to movement of the spa cover 102 on and off the spa 100.

The spa cover crossbar 144 may have at least one cover engagement region 121, and the spa cover 102 may be secured to the spa cover crossbar 144 at the cover engagement region(s) 121. In some examples, the cover engagement regions 121 of the spa cover crossbar 144 may only extend across a portion of the spa cover crossbar 144 in the forward-rearward direction 154. In the illustrated example, the spa cover crossbar 144 has cover engagement regions 121 where the spa cover straps 172 connect the spa cover 102 to the spa cover crossbar 144 (see, e.g., FIG. 1). In other examples, the cover engagement region 121 of the spa cover crossbar 144 may extend across the entire length of the spa cover crossbar 144. An entire length 184 of the spa cover crossbar 144 may form a cover engagement region 121 when the spa cover 102 is foldable over the spa cover crossbar 144 to secure the spa cover 102 to the spa cover 104. Accordingly, the cover engagement region(s) 121 may have a combined length in the forward-rearward direction 154 that is between 5% and 100% (e.g., 25% to 85%) the length of the spa cover crossbar 144 in the forward-rearward direction 154. In some examples, each cover engagement region 121 may be between 1 inch and 21 (e.g., 5 feet to 15 feet) feet in length in the forward-rearward direction 154. In examples of spa cover crossbars 144 having multiple engagement regions 121, adjacent engagement regions 121 may be spaced apart by less than 90% of the length of the spa cover crossbar 144, for example, less than 70% (e.g., 10% to 70%), less than 40% (e.g., 10% to 40%), or less than 10% (e.g., 5% to 10%). With the spa cover 102 secured to the spa cover crossbar 144 at the cover engagement region(s) 121, a user may rotate lever arm 142 to carry the spa cover 102 between the cover on position (FIG. 1) and the cover off position (FIG. 2).

The spa cover crossbar 144 may be connected to lever arm 142 in any manner that allows the spa cover crossbar 144 to move with the lever arm 142, as the user rotates the lever arm 142 between the cover closed and open positions. In some embodiments, the spa cover crossbar 144 may be rigidly connected (e.g., integrally formed with, or welded to) the lever arm 142. In other embodiments, the spa cover crossbar 144 may be connected to lever arm 142 in a manner that allows spa cover crossbar 144 to rotate about a longitudinal axis of the spa cover crossbar 144. This may mitigate or eliminate frictional wear that can occur when spa cover crossbar 144 rotates relative to spa cover 102 (FIG. 3) when moving between the cover on and off positions.

To further and/or otherwise mitigate or eliminate frictional wear that can occur at the cover engagement region(s) 121, at least a portion of the spa cover crossbar 144, which includes at least the cover engagement region(s) 121, may have a cross-sectional shape, defined by an outer surface 177 of the spa cover crossbar 144, that is curved, specifically, convexly curved. That is, at least a portion of the outer surface 177 of the spa cover crossbar 144 when looking at a cross-section taken through the cover engagement region 121 may be curved. In some examples, the entire outer surface 177 of the spa cover crossbar 144 may be convexly curved (e.g., the spa cover crossbar 144 may have a circular and/or oval shaped cross-sectional shape at least at the cover engagement regions 121). As described in more detail below, only a portion of the cross-sectional shape defined by the outer surface 177 of the spa cover crossbar 144 when looking at a cross-section taken through the cover engagement region 121 may be convexly curved. In some embodiments, no portion of the cross-sectional shape defined by the outer surface 177 of the spa cover crossbar 144 when looking at a cross-section taken through the cover engagement region 121 may be convexly curved. For example, the spa cover crossbar may have a square cross-sectional shape.

The spa cover crossbar 144 may have any configuration that allows the spa cover crossbar 144 to carry spa cover 102 between the cover on and off positions. As shown in FIG. 1, the spa cover crossbar 144 may have a length 184 in the forward-rearward direction 154 that is equal to or greater than a length 186 of the spa 100 in the forward-rearward direction 154. For example, the spa cover crossbar 144 may have a length 184 between 12 feet and 22 feet. In examples where the lift assembly 104 comprises two lever arms 142, the spa cover crossbar 144 may have a length that is equal to the distance between the first lever arm 142*a* and the second lever arm 142*b*. Alternatively, the spa cover crossbar 144 may extend only a portion of the length of the spa 100 in the forward-rearward direction 154. For example, there may be two lever arms 142*a*, 142*b* at opposite ends of the spa 100 each connected to a portion of the spa cover crossbar 144 that extends in the forward-rearward direction 154 but that are discontinuous from each other in the forward-rearward direction 154.

The spa cover crossbar 144 may be formed from a number of interconnecting portions. For example, the spa cover crossbar 144 may have at least two crossbar portions 174 that telescopically connect to each other (see, e.g., FIGS.

11A-11C). When telescopically connected, the crossbar portions 174 may be slidable relative to each other from a first position in which the spa cover crossbar 144 has a first length in the forward-rearward direction 154 to a second position in which the spa cover crossbar 144 has a second length in the forward-rearward direction 154. In some examples, the second length may be between 1 foot and 9 feet greater than the first length (e.g., the spa cover crossbar 144 may extend from a first length 184 of 12 feet to a second length 184 of 21 feet).

The spa cover crossbar 144 may be made of any number of interconnecting (e.g., telescopically connected) portions 174. For example, the spa cover crossbar 144 may have two to ten portions, such as two portions, three portions, four portions, etc. In the example illustrated in FIGS. 1 to 6, the spa cover crossbar 144 has three portions. Specifically, with reference to FIG. 6, the spa cover crossbar 144 may have a first portion 174*a* extending from (e.g., connected to or integrally formed with) the first lever arm 142*a*; a second portion 174*b* extending from the first portion 174*a*; and a third portion (not shown in FIG. 6) extending between (e.g., connected to or integrally formed with) the second lever arm and the second portion 174*b*.

It may be desirable to provide a spa cover crossbar 144 having interconnecting portions to improve the portability of the spa cover crossbar 144 and the compatibility of the spa cover crossbar with spas of different lengths. For example, a swim spa may be 21 feet in length (whereas a non-swim spa (i.e., a seated spa) is typically 8 feet in length) and therefore, as described above, the spa cover crossbar 144 may be at least 21 feet in length as well. Shipping a 21-foot-long spa cover crossbar 144 may be undesirable/unfeasible. Further, even among swim spas, the width may vary considerably. Therefore, providing a spa cover crossbar 144 having interconnecting portions that are connectable to form a spa cover crossbar 144 of various lengths can be beneficial.

In examples of spa cover crossbars 144 that are formed from multiple interconnecting portions 174, a first portion 174*a* may connect to an adjacent second portion 174*b* by any connecting mechanism known in the art. Optionally, as shown, adjacent portions 174 may be telescopically connected, and may be rigidly connectable at one of a plurality of connection points 178. This allows the length 184 of the spa cover crossbar 144 to be adjustable. The connection points 178 may be threaded for receiving a threaded fastener (not shown). Optionally, as shown in FIG. 7D, a rivet nut 183 may be secured at each connection point 178 of one of the portions of the spa cover crossbar 144 to provide a more rigid anchor for the fastener.

As is known in the art, in some examples the cross-sectional shape of each portion 174 of the spa cover crossbar 144 may be circular. As described above, it may be desirable for the cross-sectional shape of at least a portion of the spa cover crossbar 144 to be circular to reduce wear caused by relative rotation between the spa cover crossbar 144 and the spa cover 102 when moving the spa cover 102 between the cover on and off positions. However, for reasons described in more detail below, it may be desirable for the cross-sectional shape of at least a portion of the spa cover crossbar 144 to be non-circular.

For the purposes of this disclosure, it is to be understood that when describing a cross-sectional shape of the spa cover crossbar 144, the cross-section is not taken through a connection point 178 (i.e., a bore in the spa cover crossbar 144) which may be used to secure a first portion 174*a* to a second portion 174*b*. That is, the term "cross-sectional shape" refers to a closed shape and therefore does not include the bored region of the spa cover crossbar 144 where the cross-section is discontinuous (i.e. a non-closed shape) due to the bore.

When spa cover crossbars 144 having interconnecting portions 174 have circular cross-sectional shapes, it has been found that adjacent portions 174 are prone to twisting relative to each other. Adjacent portions 174 may twist relative to each other because the fastener (e.g., set screw) securing the adjacent portions 174 together may solely be responsible for inhibiting rotation of the adjacent portions 174 relative to each other. Over time, it has been found that the fasteners may break or deform (i.e., bend or e.g., deform the set screw hole) which may allow for adjacent portions 174 of the spa cover crossbar 144 to twist relative to each other. This problem is worsened in the case of swim spas because the spa cover 102 is significantly heavier and the spa cover crossbar 144 is significantly longer.

It is undesirable for adjacent portions of a spa cover crossbar 144 to twist relative to each other because, when in use, twisting of the spa cover crossbar 144 may result in one end of the spa cover 102 to rotating further and/or at a different speed from the cover closed position to the cover open position than the opposite end. This twisting and nonuniform movement may damage the lift assembly 104 and/or the spa cover 102.

Therefore, it may be desirable to provide a spa cover crossbar 144 with a circular cross-sectional shape to reduce wear on the spa cover 102; however, a spa cover crossbar 144 with a circular cross-sectional shape may be undesirable when providing a spa cover crossbar 144 having multiple interconnecting portions 174.

Systems known in the art, see for example U.S. Pat. No. 6,742,196 to LaHay, have attempted to provide a spa cover remover that limits twisting by providing a rigid rectangular frame. In particular, LaHay teaches that the upper and lower ends of sidebars must be rigidly connected to one another to resist twisting of the crossbars. To provide lower ends of sidebars that are rigidly connected to one another, LaHay describes a spa having a bore that extends through the spa, across the entire width thereof. Accordingly, a lower crossbar ("pivot shaft") extends through the spa and rigidly connect the lower ends of the sidebars. However, providing a lower crossbar extending through the full width of the spa as required by LaHay greatly limits the compatibility of the lifter with spas of shapes, sizes, and configurations. Many spas will have an empty void within their outer housing which is suitable for accommodating a lower crossbar at the location where a rotation axis is needed for the lifter to function. Instead, embodiments described herein include separate lever arm mounts 140 for each lever arm 142, which are located proximate (i.e., on or outside) the spa sidewall 108 and to which the lever arms 142 are rotatably mounted.

In view of the problem of relative twisting between adjacent portions 174 of a spa cover crossbar 144, it has been determined that providing a spa cover crossbar 144 wherein a first portion 174*a* has an inner bore 195 shaped to receive a second portion 174*b* having an outer surface 177 with cross-sectional shape that (a) nests within the inner bore 195 of the first portion 174*a*; and (b) restricts rotation of the first portion 174*a* relative to the second portion 174*b*, even without a fastener (e.g., set screw), may reduce twisting between adjacent portions.

Figure 8:
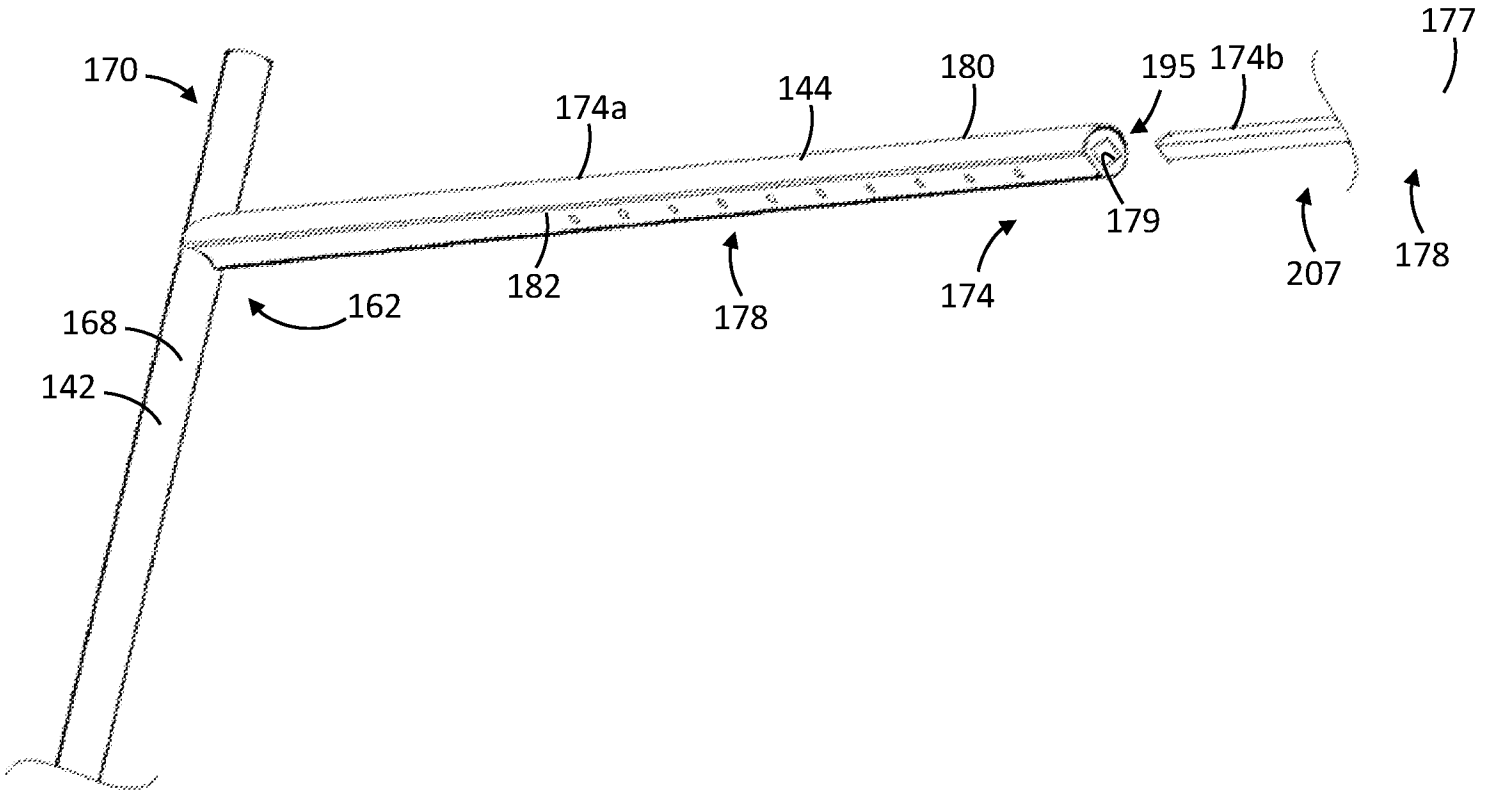
FIG. 8 is a perspective view of a lever arm and a spa cover crossbar of an exemplary lift assembly.
Figure 9:
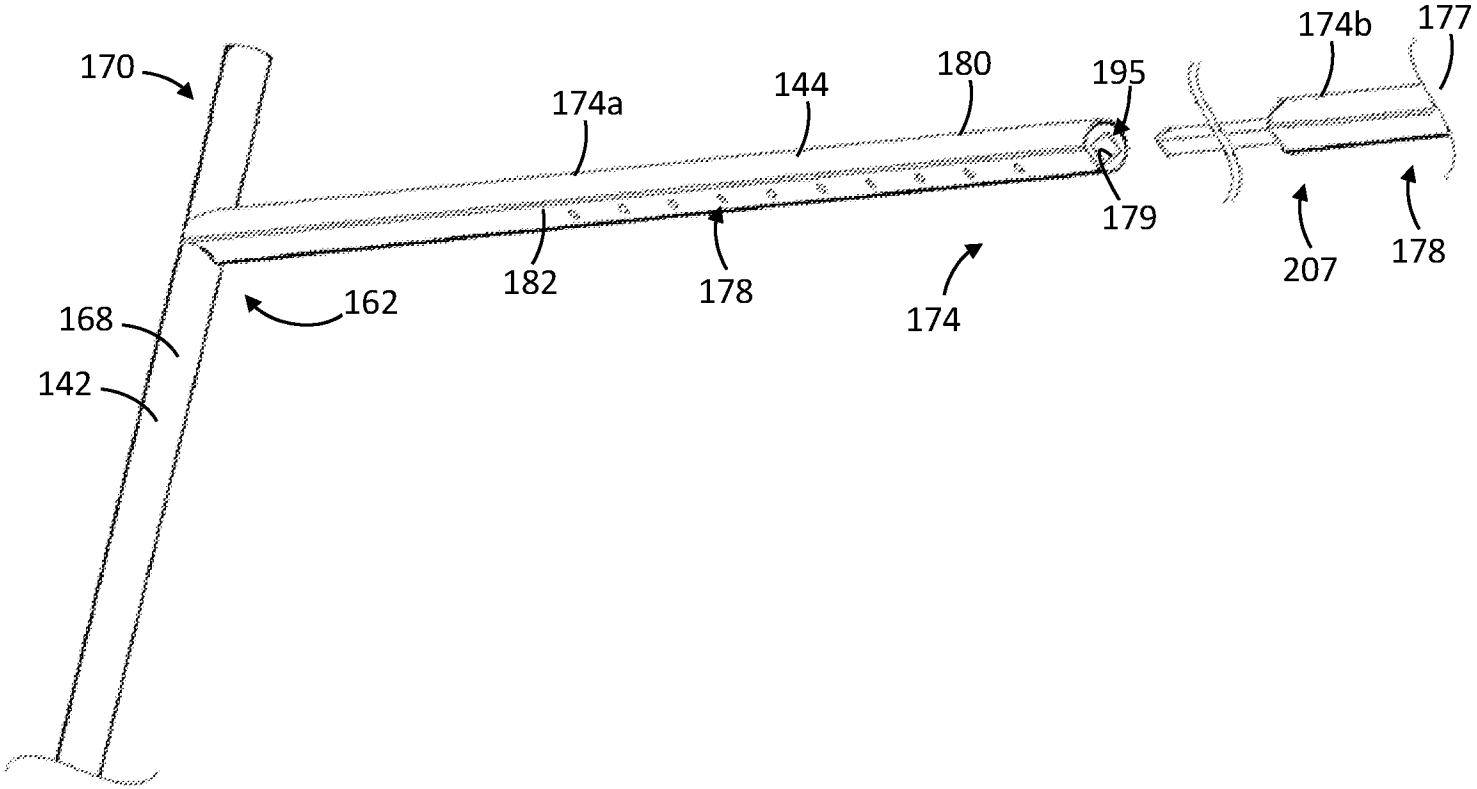
FIG. 9 is a perspective view of a lever arm and a spa cover crossbar of an exemplary lift assembly.
Figure 10B:
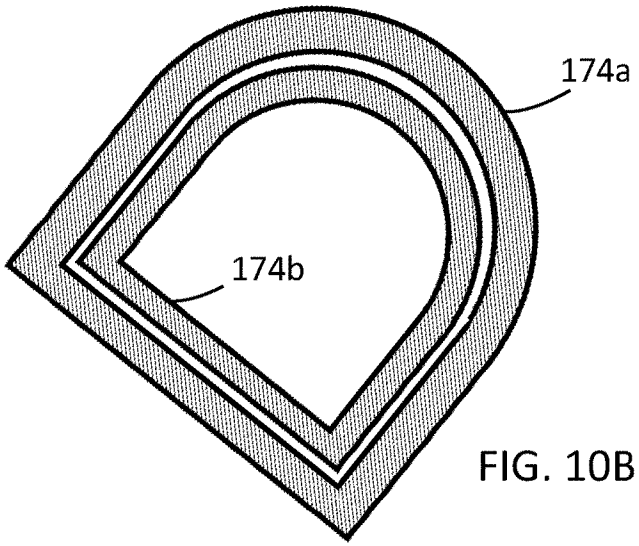
FIGS. 10A to 10L are sectional views of exemplary cross-sectional shapes of portions of a spa cover crossbar.
Figure 10A:
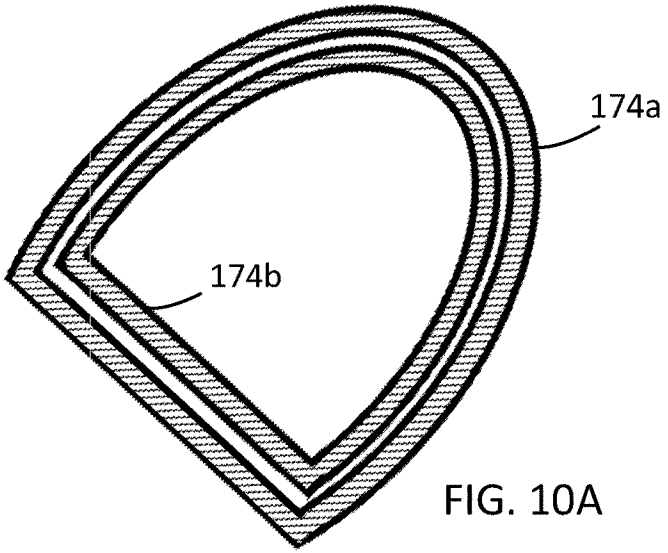
Figure 10D:
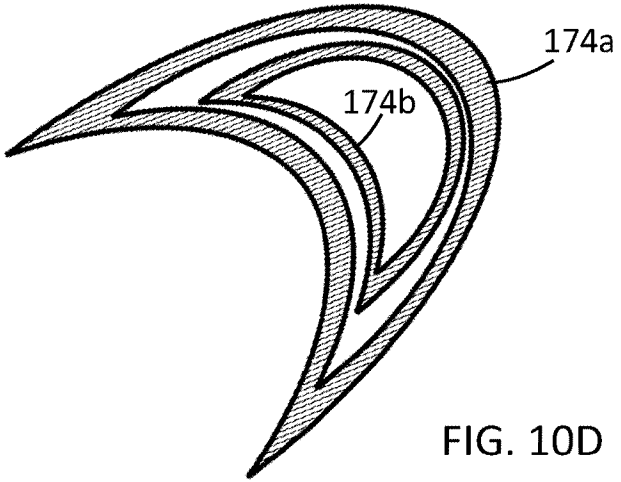
Figure 10C:
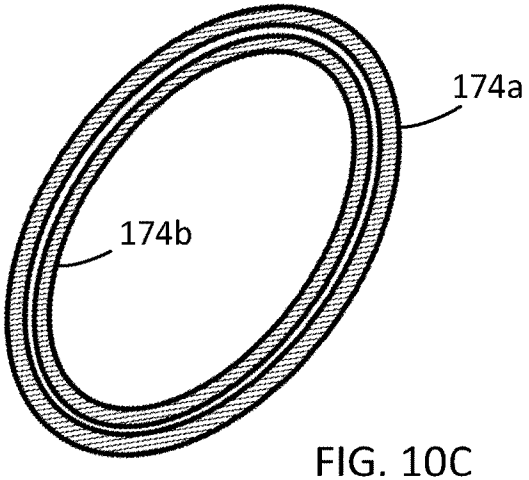
Figure 10F:
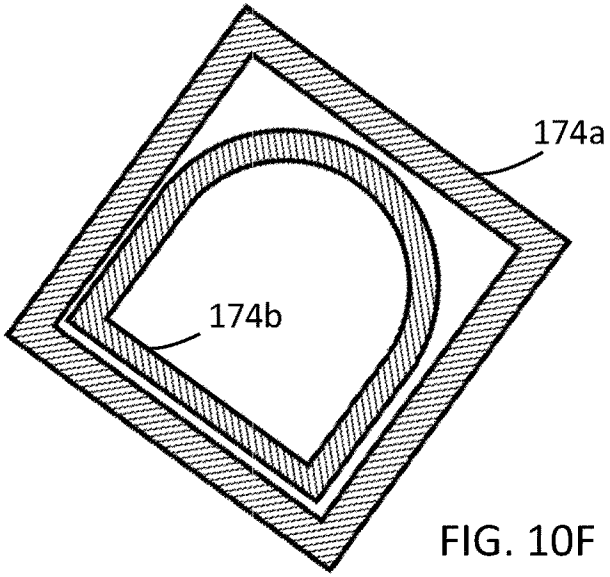
Figure 10H:
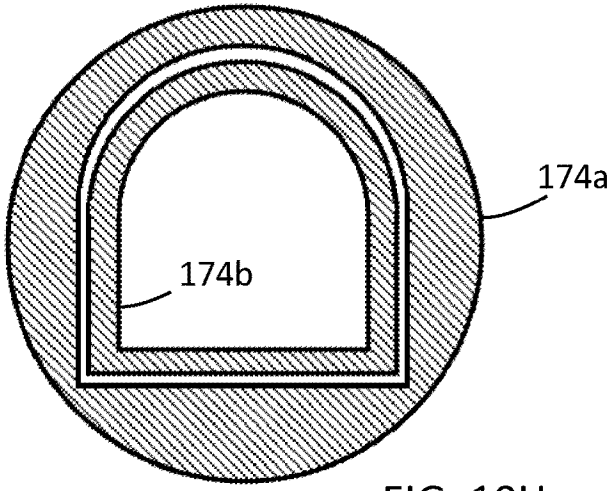
Figure 10E:
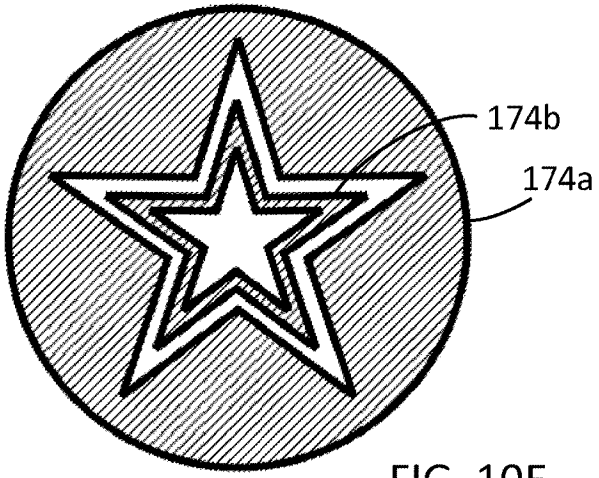
Figure 10G:
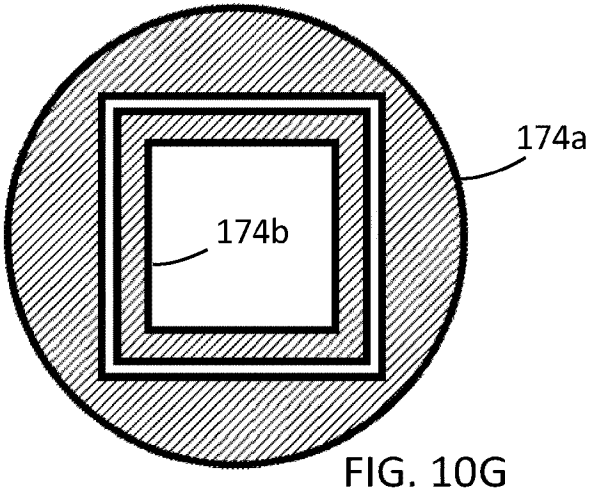
Figure 10J:
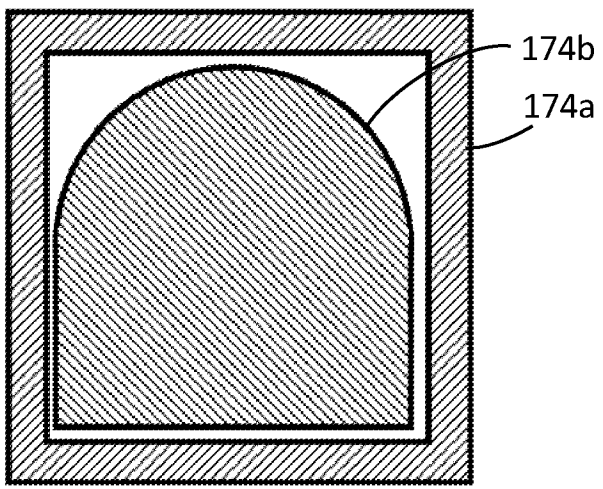
Figure 10L:
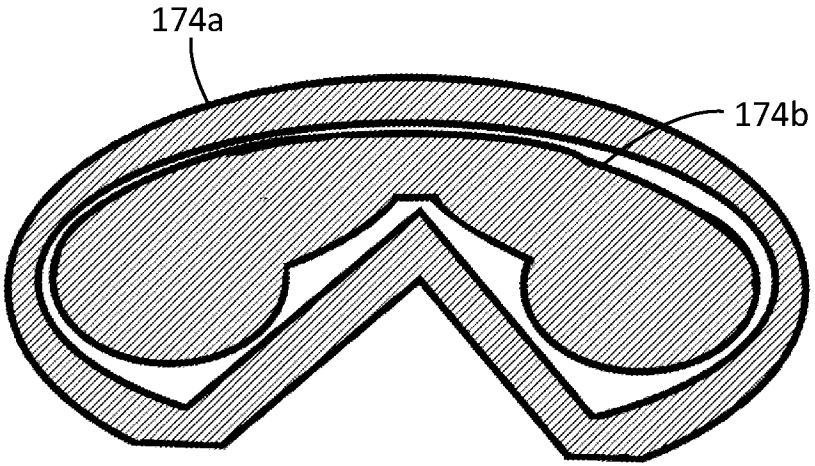
Figure 10I:
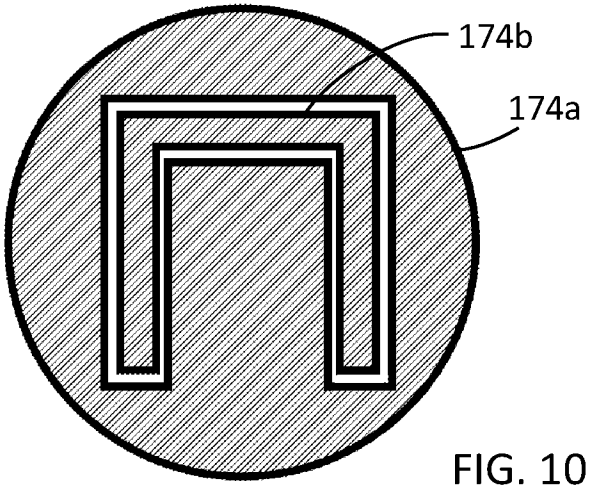
Figure 10K:
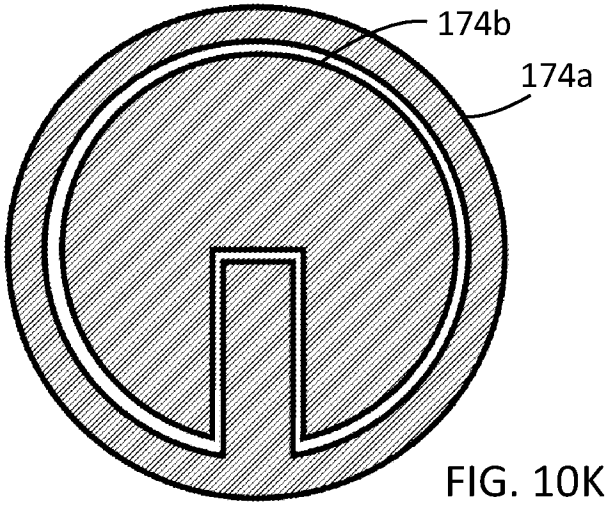

Put another way, with reference to FIGS. 6, 8, and 9, a first crossbar portion 174*a* of the spa cover crossbar 144 may have a bore 195 to telescopically receive at least an end 211 of an adjacent second crossbar portion 174*b* of the spa cover crossbar 144. The bore 195 of the first crossbar portion 174*a* may have a bore cross-sectional shape and the end 211 of the second crossbar portion 174*b* may have an end cross-sectional shape. The bore cross-sectional shape and the second crossbar portion end cross-sectional shape may be any shape and may be similar to each other or different from each other. That being said, the bore cross-sectional shape and the second crossbar portion end cross-sectional shape may be selected such that when the end 211 of the second crossbar portion 174*b* is received by the bore 195 of the first crossbar portion 174*a*, the bore cross-sectional shape and the second crossbar portion end cross-sectional shape together inhibit rotation of the first crossbar portion 174*a* relative to the second crossbar portion 174*b*. Non-limiting examples of bore cross-sectional shapes and second crossbar portion end cross-sectional shapes are shown in FIGS. 10A-10L. As shown in FIGS. 10A-10L, a portion of the bore cross-sectional shape and/or the second crossbar portion end cross-sectional shape may be convex, concave, flat, and any combination thereof. As used herein and in the claims, a surface is said to be convex when the surface protrudes in the direction of the surface normal and the surface is said to be concave when the surface recedes in the direction away from the surface normal.

Put in yet another way, with reference to FIG. 7A to 7D, the inner surface 179 of the first portion 174*a* (i.e., the surface defining the bore 195) may engage the outer surface 177 of the adjacent second portion 174*b* to transfer a rotational force applied to the first portion 174*a* to the second portion 174*b* (and vice versa).

For the purposes of this disclosure, when the second portion 174*b* has a cross-sectional shape that engages the bore 195 of the first portion 174*a* to transfer a rotational force applied to the first portion 174*a* to the second portion 174*b*, and vice versa, the second portion 174*b* is considered to have "an engaging cross-sectional shape". It is to be understood that to transfer a rotational force, the second portion 174*b* may rotate between 0 degrees and 10 degrees within the bore 195 of the first portion 174*a*. That is, an engaging cross-sectional shape may not completely inhibit relative rotation between the first portion 174*a* and the second portion 174*b*.

Figure 7B:
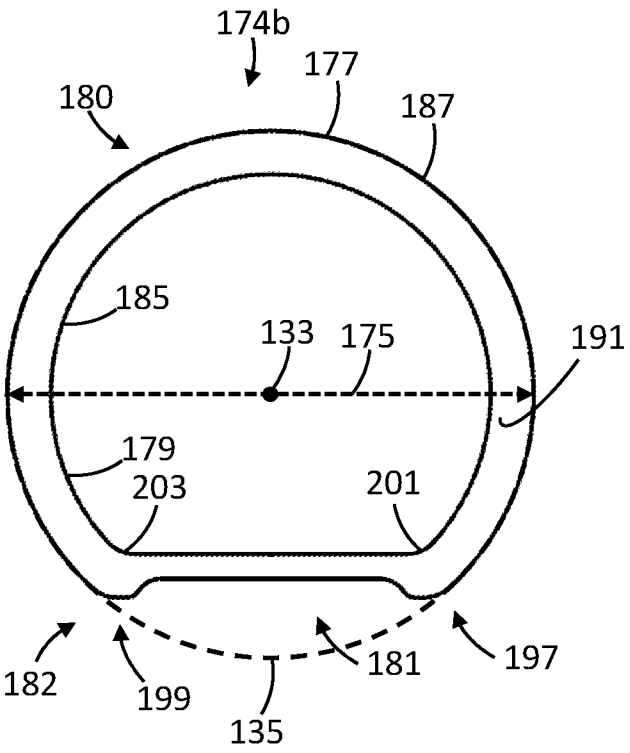
FIG. 7B is a cross-sectional view of the spa cover crossbar of FIG. 6, taken along line 7B-7B.
Figure 7A:
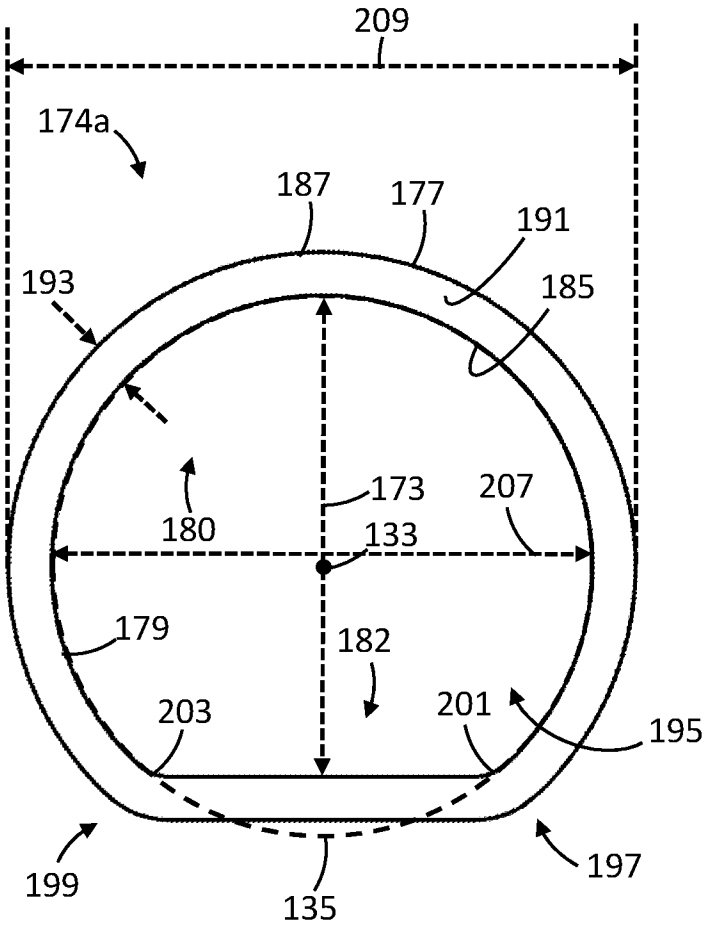
FIG. 7A is a cross-sectional view of the spa cover crossbar of FIG. 6, taken along line 7A-7A.
Figure 7C:
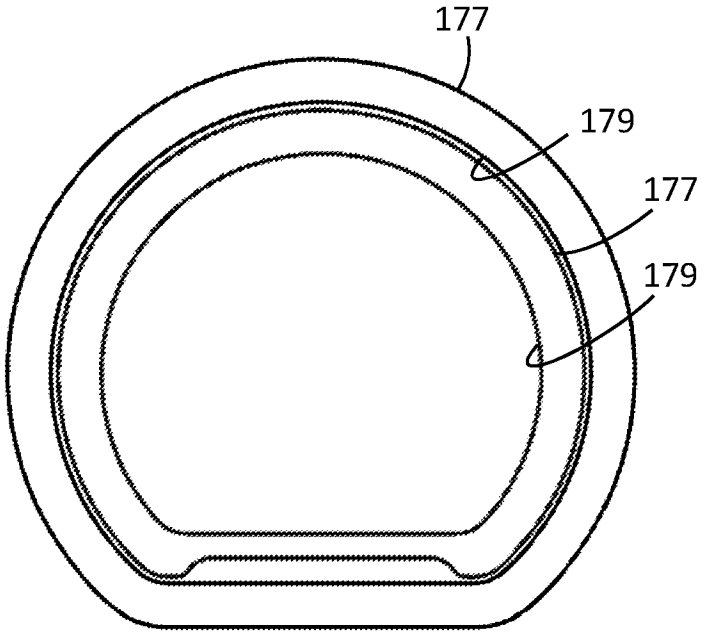
FIG. 7C shows the portion of the spa cover crossbar of FIG. 7B telescopically received by the portion of the spa cover crossbar of FIG. 7A
Figure 7D:
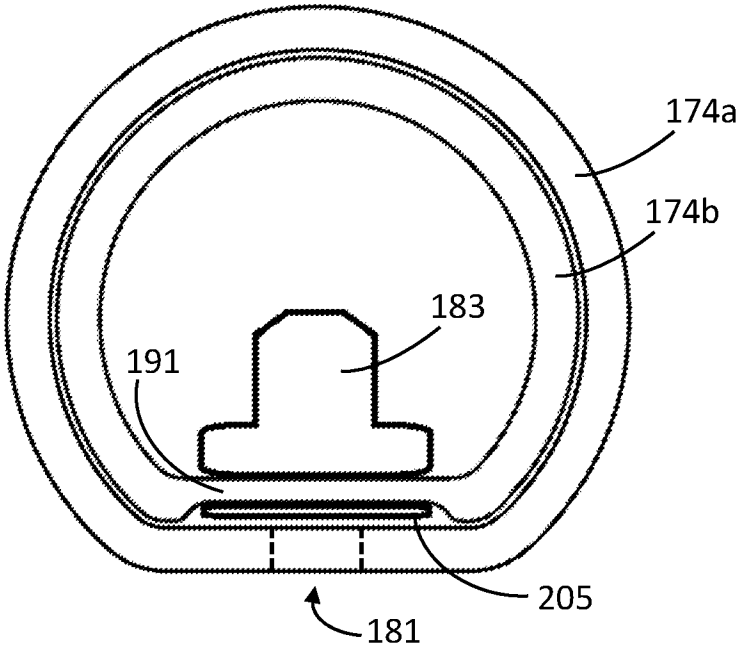
FIG. 7D shows the spa cover crossbar of FIG. 7C with a rivet nut fastener.

With reference to FIGS. 7A to 7C, in some examples, an engaging cross-sectional shape occurs when the second portion 174*b* is (a) nestable within the bore 195 of the first portion 174*a* (see FIG. 7C); and (b) a longest straight line 175 that can be drawn across the cross-section of the second portion 174*b* through a circumcenter 133 of a circumcircle 135 of the cross-section of the second portion 174*b* is longer than the shortest straight line 173 that can be drawn across the cross-section of the bore 195 through a circumcenter 133 of a circumcircle 135 of the bore 195. Put another way, an engaging cross-sectional shape occurs when the second portion 174*b* is (a) nestable within the bore 195 of the first portion 174*a*; and the largest width dimension 175 of the second portion 174*b* is larger than the smallest width 173 dimension of the bore. As used herein and in the claims, a "width dimension" of a cross-sectional shape is the distance between two parallel lines of infinite length, which are positioned tangent to opposite sides of the shape and do not cross through an interior of the shape.

While the entire length of the second crossbar portion 174*b* may have an engaging cross-sectional shape, it has been found that twisting may be reduced when only a portion of the second portion 174*b* of the spa cover crossbar 144 where adjacent crossbar portions 174 telescopically connect has an engaging cross-sectional shape.

As described above, in view of the problem of wear to the spa cover 102 from relative movement between the spa cover 102 and the spa cover crossbar 144, the cover engagement region 121 of the spa cover crossbar 144 may have a cross-sectional shape and at least a portion of the cross-sectional shape may be curved.

Accordingly, it may be desirable for the second portion 174*b* to have an engaging cross-sectional shape and at least a portion of the perimeter of the engaging cross-sectional shape may be a curved portion 180. That is, in some examples, the second portion 174*b* may include at least a portion of the cover engagement region 121 and therefore, it may be desirable for at least the portion of the second portion 174*b* that includes the cover engagement region 121 to have a cross-sectional shape that has a curved portion 180. In some examples, the second portion 174*b* may not include any of the cover engagement region 121 and therefore no portion of the second portion 174*b* may have a cross-section shape having a curved portion 180 (see e.g., FIG. 8).

Likewise, the first portion 174*a* may include at least a portion of the cover engagement region 121. Therefore, it may be desirable for at least the portion of the first portion 174*a* that includes the cover engagement region 121 to have a cross-sectional shape that has a curved portion 180. However, in some examples, the first portion 174*a* may not include a portion of the cover engagement region 121 and may therefore not have a cross-sectional shape having a curved portion 180.

In some examples, at least 30%, such as 30% to 80%, of the perimeter of the cross-sectional shape of the first and/or second portion 174*a*, 174*b* that includes the cover engagement region 121 may be curved. Optionally, the curved portion 180 may have a constant radius of curvature. In other examples, the curved portion 180 may not have a constant radius of curvature.

At opposite distal ends 197, 199 of the curved portion 180, the cross-sectional shape may have deflection points 201, 203. As shown in FIGS. 7A-7D, the deflection points 201, 203 may have a radius of curvature which is less than the average radius of curvature of the curved portion 180. Optionally, the radius of curvature of the deflection points 201, 203 may be at least 50% less, such as 70% to 90%, than that of the curved portion 180.

In some examples, at least a portion of the second portion 174*b* may have a cross-sectional shape with a curved portion 180 and the bore 195 of the first portion 174*a* may be shaped to match the cross-sectional shape of that portion of the second portion 174*b*. In this example, the average radius of curvature of the curved portion 180 of the cross-sectional shape of the second portion 174*b* may be at least 90%, such as 95% to 99%, the average radius of curvature of the curved portion 180 of the bore 195 of the first portion 174*a*. That is, for example, if the curved portion 180 of the bore of the first portion 174*a* has a radius of curvature of 0.5625 inches, the radius of curvature of the curved portion 180 of the second portion 174*b* may be 0.5475 inches.

In some examples, the surface area defined by the cross-sectional shape of the second portion 174*b* to be received by the bore of the first portion may be at least 90%, such as 94% to 99%, the surface area defined by the bore 195 of the first portion 174*a*. When the surface area defined by the cross-sectional shape of the second portion 174*b* is at least 90% of the surface area defined by bore 195 of the first portion 174*a*, the outer surface 177 of the second portion 174*b* may be more likely to engage the inner surface 179 (i.e., bore 195) of the first portion 174*a* to transfer a rotational force applied to the first portion 174*a* to the second portion 174*b* (and vice versa). When the surface area defined by the cross-sectional shape of the second portion 174*b* is less than 90% of the surface area defined by the bore 195 of the first portion 174*a*, the shape of the first portion 174*a* relative to the second portion 174*b* may not be sufficiently similar to transfer a significant amount of rotational force between the first portion 174*a* and the second portion 174*b*, and a fastener which secures the first portion 174*a* to the second portion 174*b* may be overly relied upon to transfer the rotational force between adjacent portions 174*a*, 174*b*. Still, in other embodiments, the surface area defined by the cross-sectional shape of the second portion 174*b* is less than 90% of the surface area defined by the bore 195 of the first portion 174*a*.

Referring to FIGS. 7A to 7D, each portion 174 of the spa cover crossbar 144 may have cross-sectional shape having a largest inner width 207 and a largest outer width 209. As used herein and in the claims, the largest inner width 207 of a portion 174 of the spa cover crossbar 144 is the length of the longest straight line that extends within the bore 195 of that portion (e.g., the largest inner width of a cross-section of a tube is the inner diameter thereof); the largest outer width 209 of a portion 174 of the spa cover crossbar 144 is the length of the longest straight line that extend across the cross-sectional shape (e.g., the largest outer width of a cross-section of a tube is the outer diameter thereof). In some examples, a majority of the inner perimeter 185 of the curved portion 180 may have a radius of curvature that is 25%-75% of a magnitude of the largest inner width 207. In some examples, a majority of the outer perimeter 187 of the curved portion 180 may have a radius of curvature that is 25%-75% of a magnitude of the largest outer width 209.

The outer perimeter 187 of the first portion 174*a* may have the same cross-sectional shape as inner perimeter 185 of the first portion 174*a* (as shown) (e.g., a sidewall 191 of the first portion 174*a* of the spa cover crossbar 144 may have a uniform thickness 193); however, in other examples, the outer perimeter 187 of the first portion 174*a* may be different in shape from that of the inner perimeter 185. That is, for example, the outer perimeter 187 of the first portion 174*a* may be circular in shape and the inner perimeter 185 of the first portion 174*a* may have a non-curved portion 182. Likewise, the inner perimeter 185 of the second portion 174*b* may or may not have the same cross-sectional shape as the outer perimeter 187 of the second portion 174*b*. In the example shown in FIG. 7B, the inner perimeter 185 of the second portion 174*b* has a different cross-sectional shape than the outer perimeter 187 of the second portion 174*b*. In some examples, the second portion 174*b* may be solid and may not have an inner perimeter 185. It may be desirable for the inner perimeter 185 of a portion 174 to match the outer perimeter 187 of that portion 174 as such a shape may be relatively easy to extrude.

In the example shown in FIGS. 1-3, the entire spa cover crossbar 144 has a non-circular cross-sectional shape. In other examples, only a portion of the spa cover crossbar 144 (e.g., less than 85%, such as 15%-80%, of the length of the spa cover crossbar 144) may have a non-circular cross-sectional shape.

As shown in FIGS. 1-3, when the spa cover crossbar 144 has a non-circular cross-sectional shape, the spa cover crossbar 144 may be joined to the lever arm 142 so that the curved portion 180 faces away from the lever arm pivot axis 164. Accordingly, when in use, curved portion 180 faces toward the spa cover 102 to reduce the likeliness of the spa cover 102 being damaged by the spa cover crossbar 144 while moving the spa cover 102 between the spa cover off and on positions, and the optionally non-convexly curved portion (e.g., a flat portion 182) may face away from the spa cover 102 when the spa cover 102 is the cover on position and when the spa cover 102 is in the cover off position.

Figure 11A:
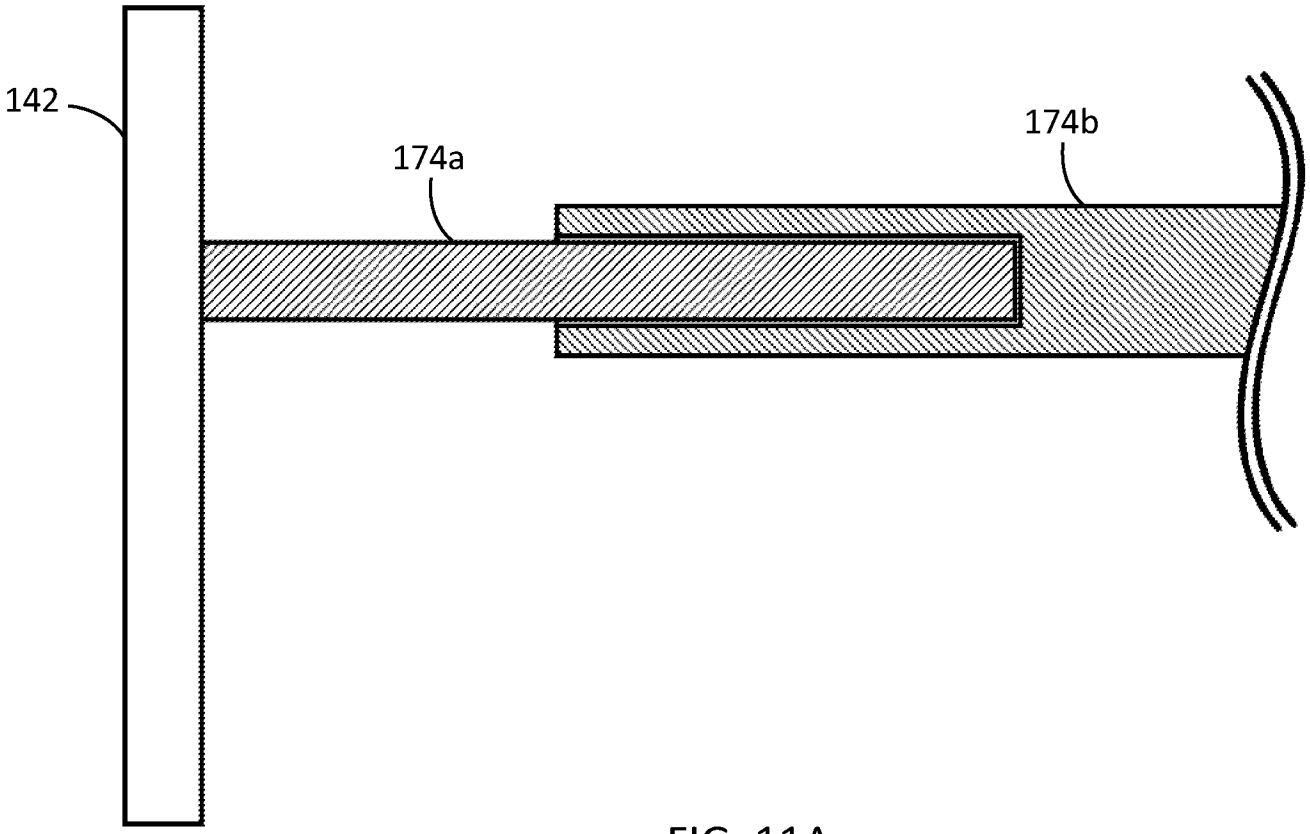
FIGS. 11A to 11C are sectional views of exemplary first portions of a spa cover crossbar secured to exemplary second portions of a spa cover crossbar.
Figure 11B:
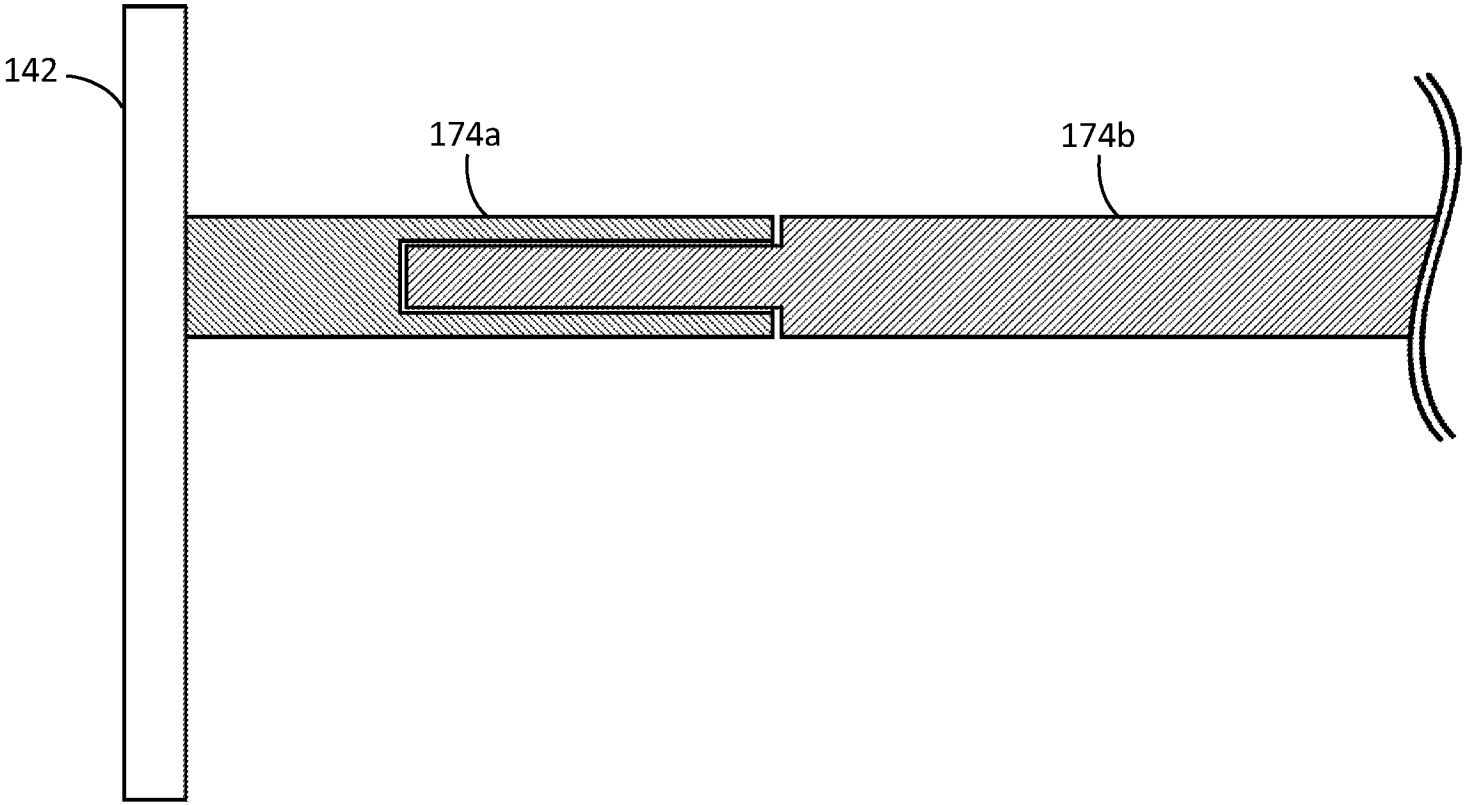
Figure 11C:
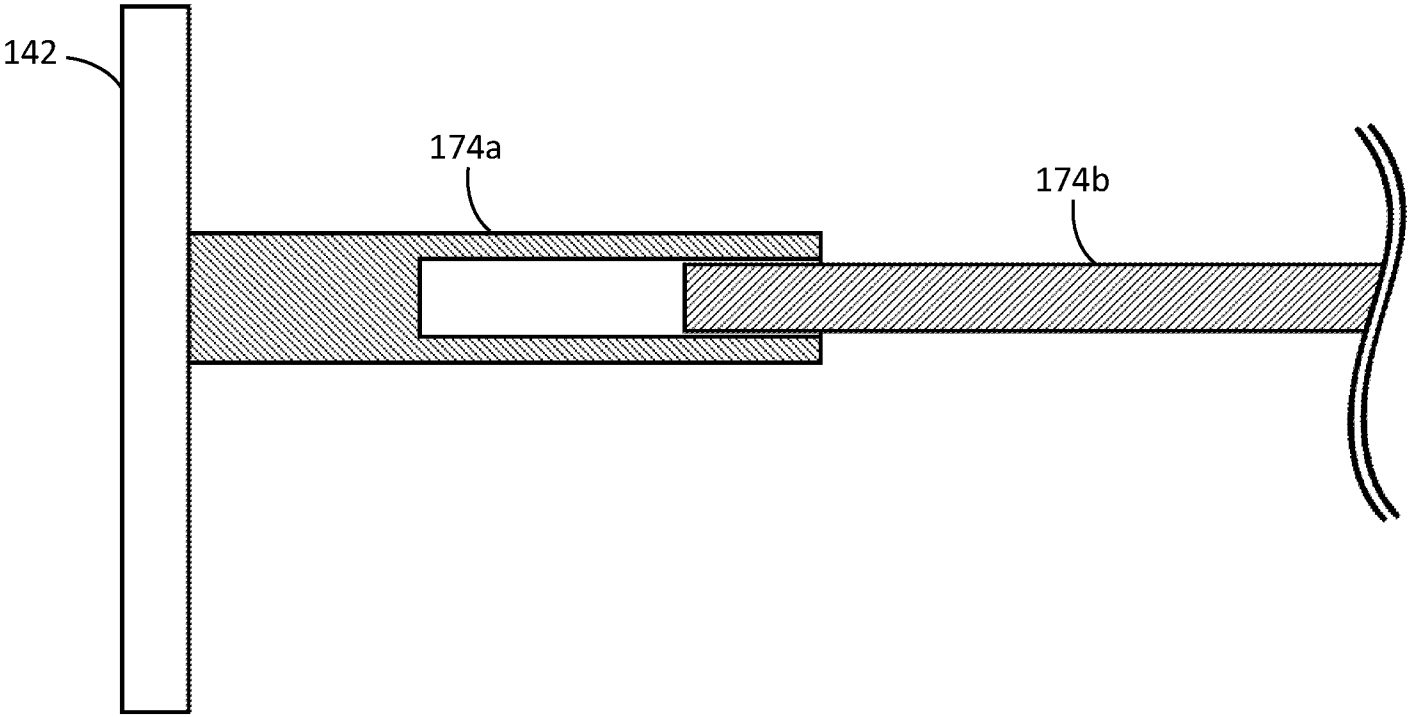

In the description above, reference is made to the figures in which the first portion 174*a* with an inner bore 195 for receiving the adjacent second portion 174*b* is connected directly to the lever arm 142. In other examples, see for example FIG. 11A, the portion of the spa cover crossbar 144 connected directly to the lever arm 142 may be the "second portion" and the "first portion" with an inner bore to receive the "second portion" may extend therefrom.

Referring now to FIG. 7D, as mentioned above, the second portion 174*b* may include at least one rivet nut 183 secured thereto. A fastener (e.g., bolt) may extend through a bore 181 in the first portion 174*a* and threadedly engage the rivet nut 183 to secure the first portion 174*a* to the second portion 174*b*. It may be desirable to include a rivet nut 183, as opposed to, for example, threading a bore in the second portion 174*b*, because the sidewall 191 of the second portion 174*b* may be made of a thin material which may fail overtime. Optionally, the second portion 174*b* may include more than one rivet nut 183, for example five rivet nuts or ten rivet nuts provided along the length of the second portion 174*b* to provide various connection portions 178. In other embodiments, second portion 174*b* may not include any rivet nuts 183.

As shown in FIG. 7B, the sidewall 191 of the second portion 174*b* may have a recessed portion 181 to receive the rivet nut 183. It may be desirable for the sidewall 191 to be recessed to the head 205 of the rivet nut 183 may not extend beyond the outer perimeter 187 of the second portion 174*b*. In other embodiments, sidewall 191 does not have a recessed portion 181.

Linear Driver

Referring to FIGS. 1-3, the lift assembly 104 may include at least one linear driver 190 connected to the lever arm 142. It may be desirable for the lift assembly 104 to include a linear driver 190 as the linear driver(s) 190 can be configured to reduce or eliminate the force required by the user (i.e., assist a user) to move the spa cover 102 (*i*) between the cover on position (FIG. 1) and the cover off position (FIG. 3), and/or (ii) between the cover off position (FIG. 3) and the cover on position (FIG. 1). This allows lift assembly 104 to make it possible (or much easier) for a user to move a heavy spa cover 102 between the cover on and off positions. Linear driver 190 may be a passive linear driver, such as a pneumatic spring as shown or a coil spring, or an active linear driver such as a linear actuator as shown in FIG. 9.

In the example illustrated, each active spa cover mount 106 of the lift assembly 104 includes two linear drivers 190*a*, 190*b*. However, it is to be understood that in other examples, an active mount 106 of the lift assembly 104 may include just one linear driver 190 or more than two linear drivers 190.

As shown, each linear driver 190 has a linear driver first end 192 and a linear driver second end 194. It will be appreciated that the distance between the linear driver first end 192 and the linear driver second end 194 is variable in that the linear driver is designed to extend and/or retract to assist with the movement of the spa cover 102 between the cover-on and cover-off positions. Optionally, as shown, in the example of linear driver 190 being a passive linear driver, such as a pneumatic or coil spring, the passive linear driver 190 may be single acting, and configured to exert only extensive force. For example, gas pressure within a pneumatic cylinder 196 of the pneumatic spring 190 may urge a piston rod 198 of the pneumatic spring 190 outwardly, whereby the pneumatic spring 190 is biased towards an extended position. In the example illustrated in FIG. 5, the pneumatic cylinder 196 is at the linear driver first end 192 and the piston rod 198 is at the linear driver second end 194. However, it will be appreciated that in other examples the pneumatic cylinder 196 may be at the linear driver second end 194 and the piston rod 198 may be at the linear driver first end 192.

The bias of the linear driver 190 may be used to assist a user to move the spa cover on and/or off the upper end 114 of the spa 100. To use the bias of the linear driver 190 to assist a user to move the spa cover 102 off the upper end 114 of the spa 100, the passive linear driver 190 may be anchored at the linear driver second end 194, be coupled at the linear driver first end 192 to the lever arm 142, be retracted (e.g. compressed) when the lever arm 142 is in the cover closed position, and provide extensive force as the lever arm 142 moves from the cover closed position towards the cover open position. To use the bias of the linear driver 190 to assist a user to move the spa cover 102 on the upper end 114 of the spa 100, the linear driver 190 may be anchored at the linear driver second end 194, be coupled at the linear driver first end 192 to the lever arm 142, be retracted (e.g. compressed) when in the cover open position, and extend as the lever arm 142 moves from the cover closed position towards the cover open position. Optionally, as shown in FIGS. 1-3, the linear driver 190 may be positioned so that it may assist a user to move the spa cover 102 on and off the upper end 114 of the spa 100.

In the example of a passive linear driver 190, such as a pneumatic spring as shown, the angular orientation of pneumatic spring 190 in the cover closed and open positions contributes to the capacity of pneumatic spring 190 to assist with moving the spa cover 102 both (i) from the cover on position to the cover off position, and (ii) from the cover off position to the cover on position. As shown in FIG. 3, the pneumatic spring 190 defines an imaginary spring line 200 that extends through pneumatic spring first end 192 and pneumatic spring second end 194 and an imaginary pivot line 202 extends through the lever arm pivot joint 152 and the pneumatic spring second end 194. There is an acute angle 204 between lines 200, 202. When acute angle 204 is negative, as it is in the cover closed position (FIG. 1), the extensive force of pneumatic spring 190 urges lever arm 142 to rotate towards the cover open position (FIG. 3). When acute angle 204 is positive, as it is in the cover opened position (FIG. 3), the extensive force of pneumatic spring 190 urges lever arm 142 to rotate towards the cover closed position (FIG. 1). References to a "positive" and "negative" angle 204 in the previous statements may be reversed depending on the direction of rotation between the cover closed and open positions.

The linear driver second end 194 must be carefully positioned in order to provide the angular relationships that allow the passive linear driver 190 to assist with both closing and opening spa cover 102. In some examples, the linear driver second end 194 may be secured directly to the sidewall 108. Alternatively, as shown in the example illustrated in FIGS. 1-3, the lever arm mount 140 may have a driver mounting portion 206 to which the linear driver second end 194 may be secured. Accordingly, in some examples, the lever arm mount 140 may support pivoting connections to both the lever arm 142 and the linear driver 190.

In the illustrated example, the driver mounting portion 206 is configured as an arm that extends away from lever arm pivot joint 160. Accordingly, the driver mounting portion 206 may extend longitudinally from a driver mounting portion first end 208 proximate the lever arm pivot joint, to a driver mounting portion second end 210. The pivoting connection of linear driver second end 194 may be located proximate the driver mounting portion second end 210.

In the example illustrated, the driver mounting portion 206 is configured as an integral component of the lever arm mount 140. However, it is to be understood that in other examples the entire lever arm mount 140, including the driver mounting portion 206, may be configured as individual components.

Providing a lever arm mount 140 with a driver mounting portion 206 avoids the need for a separate mount (e.g., fastened to the spa sidewall 108) at the location of linear driver second end 194. It may be desirable to provide a lever arm mount 140 having a driver mounting portion 206, because this allows for the angular configuration of linear driver 190 (e.g., pneumatic spring) to be predetermined for the user (mitigating user error during installation), so that lift assembly 104 may provide assistance in both the cover closed and open positions.

As shown, the pivoting connection of linear driver second end 194 may be located at an elevation below lever arm pivot axis 164. This allows most of linear driver 190 to remain below lever arm pivot axis 164 in both the spa cover closed position and the spa cover open position. Preferably, lever arm pivot axis 164 is located below spa upper end 114. In this case, the linear driver 190 may provide little or no interference with users' entry into and exit from spa interior chamber 112.

As shown, an active mount 106 of lifting assembly 104 may include two linear drivers 190*a*, 190*b*. It may be desirable to provide two linear drivers 190*a*, 190*b* to increase the assistance provided by the linear drivers 190*a*, 190*b* to the user. In addition, providing two linear drivers 190*a*, 190*b* allows for a first linear driver 190*a* to be positioned on a forward side 188 of the lever arm 142 and a second linear driver 190*b* to be position on a rearward side 189 of the lever arm 142. It has been determined that providing one linear driver 190 with a higher biasing force only on one side of the lever arm 142 may create torque that causes the lever arm 142 to twist relative to the lever arm mount 140 (which can be particularly problematic on large spas, such as swim spas which have long arm lengths and heavy covers). By providing two linear driver 190*a*, 190*b*, each opposing forward and rearward sides 188, 189 of the lever arm 142, the linear drivers 190*a*, 190*b* may balance the torsional force exerted by the linear drivers 190*a*, 190*b* on the lever arm pivot joint 152. This may reduce or eliminate the aforementioned twisting of lever arm 142.

In the example of a passive linear driver 190, such as a pneumatic spring as shown, to balance the torsional force at the lever arm pivot joint 152, a force profile of the first pneumatic spring 190*a* and the second pneumatic spring 190*b* may be the same. A force profile of a pneumatic spring 190 is the amount of force the pneumatic spring 190 exerts on the lever arm 142 at a certain angular position of the lever arm 142 relative to the lever arm mount 140. It is to be understood that a force profile of a first pneumatic spring 190*a* is the same as the force profile of a second pneumatic spring 190*b* if the magnitude of the force the pneumatic springs 190*a*, 190*b* exert on the lever arm 142 at a certain angular position of the lever arm 142 relative to the lever arm mount is within plus or minus 10% of each other.

Optionally, to provide pneumatic springs 190 with the same force profile, pneumatic springs 190 having the same characteristics may be provided. For example, an extended length and a retracted length of the first and second pneumatics springs 190*a*, 190*b* may be the same (i.e., plus or minus 10%) and/or the spring force exerted by pneumatic springs 190*a*, 190*b* as they move from their extended length to their retracted length may be the same (plus or minus 10%). Likewise, in the example of an active linear driver 190, the extended length and the retracted length of the first and second linear driver 190*a*, 190*b* may be the same (i.e., plus or minus 10%).

As shown in FIGS. 1-3, when an active mount 106 of lifting assembly 104 includes two linear drivers 190*a*, 190*b* and the linear driver second ends 194 are coupled to the lever arm mount 140 (i.e., driver mounting portion 206), the first linear driver 190*a* may be positioned on a forward side 216 of the lever arm mount 140 and the second linear driver 190*b* may be position on a rearward side 217 of the lever arm mount 140. It may be desirable to position the linear driver 190*a*, 190*b* in this way to balance a torsional force applied by the linear driver 190*a*, 190*b* on the lever arm mount 140.

With reference to FIG. 4, optionally, as shown, the linear driver first ends 192 of the linear driver may have a common first linear driver end pivot axis 212. Likewise, the linear driver second ends 194 of the linear driver may have a common second linear driver end pivot axis 214. This symmetry may contribute to the symmetry of force exerted by linear drivers 190*a*, 190*b* to mitigate the aforementioned torque problems.

Overrotation Inhibiter

In some examples, the lifting assembly 104 may include an overrotation inhibiter 218. The overrotation inhibiter 218 limits the amount the lever arm 142 can rotate relative to the lever arm mount 142 away from cover closed position.

Figure 5:
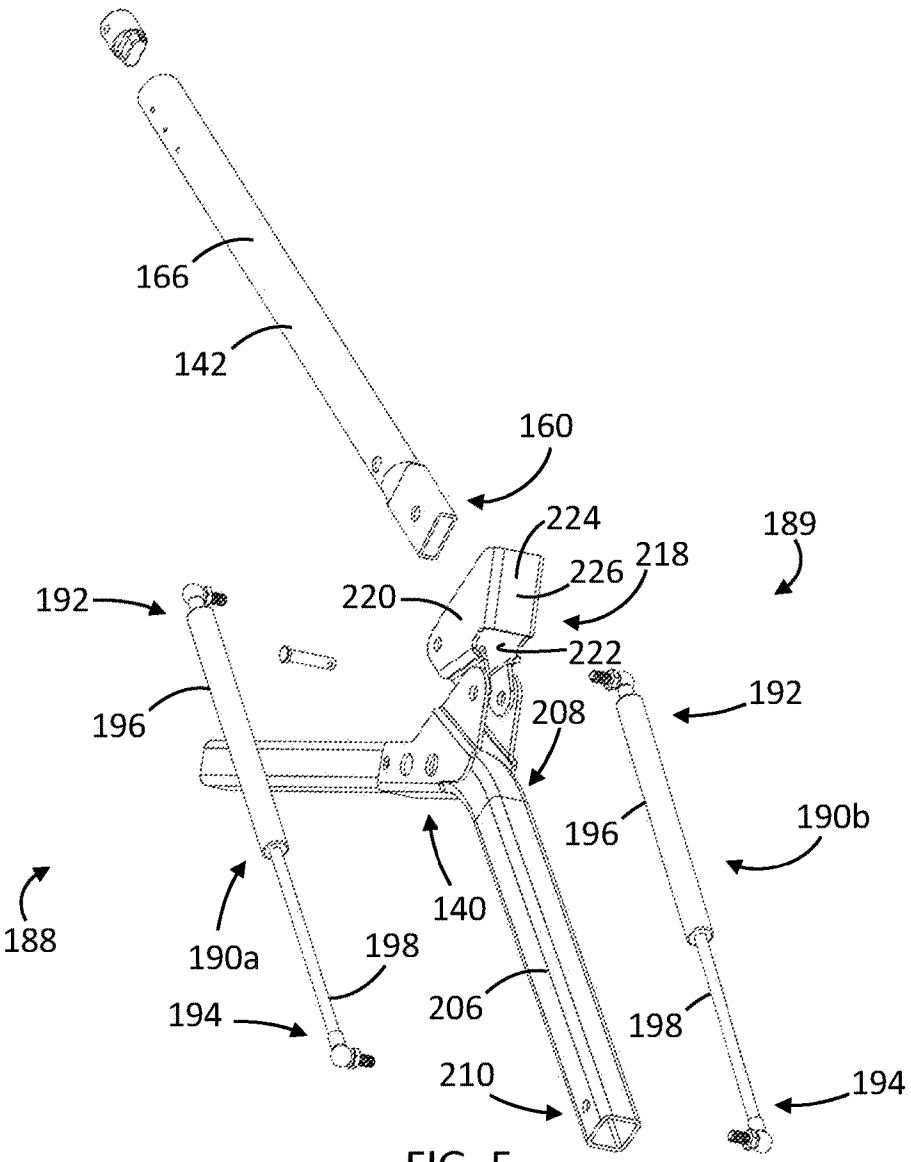
FIG. 5 is an exploded view of the lever arm, the lever arm mount, and the first and second pneumatic springs of FIG. 4.

Reference is now made to FIG. 5. As shown, the overrotation inhibiter 218 may include a forward plate 220 connected to the forward side 188 of lever arm 142 and a rearward plate 222 connected to the rearward side 189 of the lever arm 142. As shown, the forward plate 220 and/or the rearward plate 222 may extend transverse to the forward-rearward direction 154. Optionally, the forward plate 220 and the rearward plate 222 may extend perpendicular to the lever arm pivot axis 164. As shown, a contact plate 224 may extend between the forward plate 220 and the rearward plate 222. For example, contact plate 224 may extend in the forward-rearward direction 154 (e.g. parallel to lever arm pivot axis 164). In some examples, as shown, the forward plate 220, the rearward plate 222, and the contact plate 224 may be integrally formed.

Referring now to FIG. 3, when in the cover open position, the contact plate 224 may abut the lever arm mount 140 to inhibit further rotation of the lever arm 142 away from the cover closed position. More specifically, a contact surface 226 of the contact plate 224 may abut the lever arm mount 140 when in the cover open position.

In the example shown, the overrotation inhibiter 218 is mounted to the lever arm 142. The overrotation inhibiter 218 may be positioned at any location along the lever arm 142. As shown, the overrotation inhibiter 218 may be positioned such that the lever arm pivot axis 164 extends through the overrotation inhibiter 218. Specifically, in the example illustrated, the lever arm pivot axis 164 extends through each of the forward plate 220 and the rearward plate 222 of the overrotation inhibiter 218.

Optionally, as shown, the linear driver first end 192 of the linear driver 190 may also be pivotally coupled to the overrotation inhibiter 218. In the example shown, the linear driver first end of each of the first and second linear driver 190*a*, 190*b* is coupled to each of the forward plate 220 and the rearward plate 222 of the overrotation inhibiter 218.

In other examples, the overrotation inhibiter 218 may be secured to the lever arm mount 140. It will be appreciated that when mounted to the lever arm mount 140, the overrotation inhibiter 218 may limit rotation of the lever arm 142 in a similar manner to that described above but remain stationary as opposed to pivot with the lever arm 142. It may be desirable for the overrotation inhibiter 218 to connect to both the forward and rearward sides 188, 189 of the lever arm 142 so that a force applied to the lever arm 142 via the overrotation inhibiter 218 may be applied to the lever arm 142 on either side of the lever arm 142 in a balanced way that reduces or eliminates torquing the lever arm 142 in the forward-rearward direction 154.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items:

Item 1. A lift assembly for assisting a user to move a spa cover off of a spa, the lift assembly comprising:

a lever arm mount;

a lever arm longitudinally extending from a lever arm first end to a lever arm second end, the lever arm pivotally coupled to the lever arm mount at a lever arm pivot joint proximate the lever arm first end, the lever arm pivot joint defining a lever arm pivot axis extending in a forward-rearward direction;

a spa cover crossbar extending from proximate the lever arm second end, the spa cover crossbar extending transversely to the lever arm;

a first and a second linear drivers each having a linear driver first end and a linear driver second end, the linear driver first ends of the first and second linear drivers pivotally coupled to the lever arm, the linear driver first end of the first linear driver positioned on a forward side the lever arm, and the linear driver first end of the second linear driver positioned on a rearward side of the lever arm;

wherein, the lever arm is pivotable about the lever arm pivot axis between a cover closed position, and a cover open position; and in the cover closed position the first and second linear drivers are operable to urge the lever arm to rotate toward the cover open position.

Item 2. The lift assembly of any preceding item, wherein in the cover open position the first and second linear drivers urge the lever arm to rotate toward the cover closed position.

Item 3. The lift assembly of any preceding item, wherein the linear driver second ends of the first and second linear drivers are pivotally coupled to the lever arm mount.

Item 4. The lift assembly of any preceding item, wherein the linear driver second end of the first linear driver is positioned on a forward side the lever arm mount, and the linear driver second end of the second linear driver is positioned on a rearward side of the lever arm mount.

Item 5. The lift assembly of any preceding item, wherein the linear driver first ends of the first and second linear drivers have a common first linear driver end pivot axis.

Item 6. The lift assembly of any preceding item, wherein the linear driver second ends of the first and second linear drivers have a common second linear driver end pivot axis.

Item 7. The lift assembly of any preceding item, wherein the first and a second linear drivers are passive linear drivers.

Item 8. The lift assembly of any preceding item, wherein the first linear driver is a first pneumatic spring and the second linear driver is a second pneumatic spring and the first pneumatic spring and the second pneumatic spring have the same spring force profile.

Item 9. The lift assembly of any preceding item, wherein the first pneumatic spring has an extended length and a retracted length, the second pneumatic spring has an extended length and a retracted length; and the extended length of the first pneumatic spring is equal to the extended length of the second pneumatic spring and the retracted length of the first pneumatic spring is equal to the retracted length of the second pneumatic spring.

Item 10. The lift assembly of any preceding item, wherein the first linear driver has an extended length and a retracted length, the second linear driver has an extended length and a retracted length; and the extended length of the first linear driver is equal to the extended length of the second linear driver and the retracted length of the first linear driver is equal to the retracted length of the second linear driver.

Item 11. The lift assembly of any preceding item, wherein at least a portion of the spa cover crossbar has a cross-sectional shape defined at least in part by a curved portion and a flat portion.

Item 12. The lift assembly of any preceding item further comprising an overrotation inhibiter coupled to the lever arm, the overrotation inhibiter is pivotable about the pivot axis with the lever arm wherein, when the lever arm is in the cover open position the overrotation inhibiter abuts the lever arm mount to restrict further rotation of the lever arm away from the cover closed position.

Item 13. The lift assembly of any preceding item, further comprising:

a second lever arm mount;

a second lever arm longitudinally extending from a second lever arm first end to a second lever arm second end, the second lever arm pivotally coupled to the second lever arm mount at a second lever arm pivot joint proximate the second lever arm first end, the second lever arm pivot joint defining a second lever arm pivot axis extending in the forward-rearward direction;

the spa cover crossbar extending from proximate the second lever arm second end, the spa cover crossbar extending transversely to the second lever arm;

a third and a fourth linear driver each having a linear driver first end and a linear driver second end, the linear driver first ends of the third and fourth linear drivers pivotally coupled to the second lever arm, the linear driver first end of the third linear driver positioned on a forward side the second lever arm, and the linear driver first end of the fourth linear driver positioned on a rearward side of the second lever arm;

wherein, the second lever arm is pivotable about the second lever arm pivot axis between the cover closed position, and the cover open position; and in the cover closed position the third and fourth linear drivers urge the second lever arm to rotate toward the cover open position.

Item 14. A lift assembly for assisting a user to move a spa cover off of a spa, the lift assembly comprising:

a lever arm mount;

a lever arm longitudinally extending from a lever arm first end to a lever arm second end, the lever arm pivotally coupled to the lever arm mount at a lever arm pivot joint proximate the lever arm first end, the lever arm pivot joint defining a lever arm pivot axis extending in a forward-rearward direction;

a spa cover crossbar extending from proximate the lever arm second end, the spa cover crossbar extending transversely to the lever arm;

at least one linear driver, each linear driver of the at least one linear driver having a first linear driver end and a second linear driver end, the first linear driver end of each linear driver of the at least one linear driver pivotally coupled to the lever arm; and an overrotation inhibiter having a forward plate connected to a forward side of the lever arm;

a rearward plate connected to a rearward side of the lever arm; and a contact plate extending between the forward plate and the rearward plate wherein, the lever arm is pivotable about the lever arm pivot axis between a cover closed position and a cover open position;

in the cover closed position, each linear driver of the at least one linear driver urge the lever arm to rotate toward the cover open position; and in the cover open position, the contact plate abuts the lever arm mount to inhibit rotation of the lever arm away from the cover closed position.

Item 15. The lift assembly of any preceding item, wherein the lever arm pivot axis extends through the forward plate and the rearward plate of the overrotation inhibiter.

Item 16. The lift assembly of any preceding item, wherein the first linear driver end of each linear driver of the at least one linear driver is pivotally coupled to at least one of the forward plate and the rearward plate of the overrotation inhibiter.

Item 17. The lift assembly of any preceding item, wherein the forward plate and the rearward plate extend perpendicular to the lever arm pivot axis.

Item 18. A lift assembly for assisting a user to move a spa cover of a spa, the lift assembly comprising:

a first lever arm mount;

a second lever arm mount;

a first lever arm longitudinally extending from a first lever arm first end to a first lever arm second end, the first lever arm pivotally coupled to the first lever arm mount at a first lever arm pivot joint proximate the first lever arm first end, the first lever arm rotatable relative to the first lever arm mount at the first lever arm pivot joint, the first lever arm pivot joint defining a lever arm pivot axis extending in a forward-rearward direction;

a second lever arm longitudinally extending from a second lever arm first end to a second lever arm second end, the second lever arm pivotally coupled to the second lever arm mount at a second lever arm pivot joint proximate the second lever arm first end, the second lever arm rotatable relative to the second lever arm mount at the second lever arm pivot joint;

a spa cover crossbar extending from proximate the first lever arm second end to proximate the second lever arm second end, the spa cover crossbar extending transversely to the first lever arm and the second lever arm, the spa cover crossbar having an outer surface defining a cross-sectional shape of the spa cover crossbar, and at least a portion the cross-sectional shape of at least a portion of the spa cover crossbar having a convexly curved portion, the spa cover crossbar having at least two crossbar portions telescopically connected to each other, the at least two crossbar portions slidable relative to each other from a first position in which the spa cover crossbar has a first length in the forward-rearward direction to a second position in which the spa cover crossbar has a second length in the forward-rearward direction, wherein the second length is greater than the first length, a first crossbar portion of the at least two crossbar portions having a bore to telescopically receive an end of a second crossbar portion of the at least two crossbar portions, the bore of the first crossbar portion having a bore cross-sectional shape;

the end of the second crossbar portion having a second crossbar portion end cross-sectional shape;

wherein when the end of the second crossbar portion is received by the bore of the first crossbar portion, the bore cross-sectional shape and the second crossbar portion end cross-sectional shape together inhibit rotation of the first crossbar portion relative to the second crossbar portion, wherein, the first lever arm and the second lever arm are pivotable about the lever arm pivot axis between a cover closed position, and a cover open position; and in the cover closed position each linear driver of the at least one linear driver urges the lever arm to rotate toward the cover open position.

Item 19. The lift assembly of any preceding item, wherein a smallest width dimension of the bore of the first crossbar portion is smaller than a largest width dimension of the end of the second crossbar portion.

Item 20. The lift assembly of any preceding item, wherein at least a portion of the second crossbar portion end cross-sectional shape is convexly curved.

Item 21. The lift assembly of any preceding item, wherein at least a portion of an outer surface of the first crossbar portion is convexly curved.

Item 22. The lift assembly of any preceding item, wherein at least a portion of the bore of the first crossbar portion is concave.

Item 23. The lift assembly of any preceding item, wherein the end of the second crossbar portion has an engaging cross-sectional shape and no portion of the engaging cross-sectional shape is convexly curved.

Item 24. The lift assembly of any preceding item, wherein the bore of the first crossbar portion defines a bore surface area;

the end of the second crossbar portion defines a second crossbar portion end surface area; and the second crossbar portion end surface area measures at least 90% of the bore surface area.

Item 25. The lift assembly of any preceding item, wherein the at least two crossbar portions of the spa cover crossbar comprises:

a first portion extending from the first lever arm second end;

a second portion extending from the second lever arm second end; and a third portion extending between the first portion and the second portion;

wherein the third portion is telescopically securable to at least one of the first and second portions.

Item 26. The lift assembly of any preceding item, wherein the first portion and the first lever arm are integrally formed; and the second portion and the second lever arm are integrally formed.

Item 27. The lift assembly of any preceding item, wherein at least a portion of the convexly curved portion of the spa cover crossbar faces away from the lever arm pivot axis when the first and second lever arms are the cover closed position and when the first and second lever arms are in the cover open position.

Item 28. The lift assembly of any preceding item, wherein the crossbar has a length extending between the first lever arm and the second lever arm and the convexly curved portion extends the entire length of the crossbar.

Item 29. The lift assembly of any preceding item, wherein the portion of the spa cover crossbar that has the cross-sectional shape defined at least in part by the convexly curved portion has a outer perimeter and at least 30% of the perimeter is formed by the convexly curved portion.

Item 30. The lift assembly of any preceding item, wherein the portion of the spa cover crossbar that has the cross-sectional shape defined at least in part by the convexly curved portion has a largest outer width and an outer perimeter of the curved portion has a radius of curvature that is between 35% and 75% a magnitude of the largest outer width.

Item 31. The lift assembly of any preceding item, wherein the first length is greater than 12 feet and the second length is less than 21 feet.

The invention claimed is:

1. A lift assembly for assisting a user to move a spa cover off of a spa, the lift assembly comprising:

a lever arm longitudinally extending from a lever arm first end to a lever arm second end, the lever arm having a lever arm joint proximate the lever arm first end; and first and second linear drivers, each having a linear driver first end and a linear driver second end, the lever arm having opposing first and second sides, the linear driver first end of the first linear driver connected to the first side of the lever arm and the linear driver first end of the second linear driver connected to the second side of the lever arm, wherein, the lever arm joint provides the lever arm with movability between a cover closed position, and a cover open position, and in the cover closed position the first and second linear drivers are operable to urge the lever arm to move toward the cover open position.

2. The lift assembly of claim 1, further comprising a lever arm mount, wherein the lever arm is connected to the lever arm mount at the lever arm joint.

3. The lift assembly of claim 1, wherein in the cover open position the first and second linear drivers are operable to urge the lever arm to move toward the cover closed position.

4. The lift assembly of claim 1, further comprising a lever arm mount, wherein the linear driver second end of each of the first and second linear drivers is pivotally connected to the lever arm mount.

5. The lift assembly of claim 4, wherein the linear driver second end of the first linear driver is positioned on the first side of the lever arm and the linear driver second end of the second linear driver is positioned on the second side of the lever arm.

6. The lift assembly of claim 1, wherein the linear driver first ends of the first and second linear drivers have a common first linear driver end pivot axis.

7. The lift assembly of claim 5, wherein the linear driver second ends of the first and second linear drivers have a common second linear driver end pivot axis.

8. The lift assembly of claim 1, wherein the first and a second linear drivers are passive linear drivers.

9. The lift assembly of claim 1, wherein the first linear driver is a first pneumatic spring and the second linear driver is a second pneumatic spring and the first pneumatic spring and the second pneumatic spring have substantially the same spring force profile.

10. The lift assembly of claim 9, wherein the first pneumatic spring has an extended length and a retracted length, the second pneumatic spring has an extended length and a retracted length; and the extended length of the first pneumatic spring is equal to the extended length of the second pneumatic spring and the retracted length of the first pneumatic spring is equal to the retracted length of the second pneumatic spring.

11. A lift assembly for assisting a user to move a spa cover off of a spa, the lift assembly comprising:

a lever arm mount;

a lever arm longitudinally extending from a lever arm first end to a lever arm second end, the lever arm connected to the lever arm mount at a lever arm joint proximate the lever arm first end;

at least one linear driver, each linear driver of the at least one linear driver having a first linear driver end and a second linear driver end, the first linear driver end of each linear driver of the at least one linear driver is connected to the lever arm; and an overrotation inhibiter wherein, the lever arm joint provides the lever arm with moveability between a cover closed position and a cover open position;

in the cover closed position, each linear driver of the at least one linear driver is operable to urge the lever arm to move toward the cover open position; and in the cover open position, the overrotation inhibiter abuts the lever arm mount to inhibit movement of the lever arm away from the cover closed position.

12. The lift assembly of claim 11, wherein the lever arm joint has a pivot axis that extends through the overrotation inhibiter.

13. The lift assembly of claim 11, wherein the first linear driver end of each linear driver of the at least one linear driver is pivotally coupled to the overrotation inhibiter.

14. A lift assembly for assisting a user to move a spa cover of a spa, the lift assembly comprising:

a first lever arm longitudinally extending from a first lever arm first end to a first lever arm second end, the first lever arm having a first lever arm joint proximate the first lever arm first end;

a second lever arm longitudinally extending from a second lever arm first end to a second lever arm second end, the second lever arm having a second lever arm joint proximate the second lever arm first end;

a spa cover crossbar extending transversely from proximate the first lever arm second end to proximate the second lever arm second end, the spa cover crossbar having an outer surface defining a cross-sectional shape of the spa cover crossbar, and at least a portion the cross-sectional shape of at least a portion of the spa cover crossbar having a convexly curved portion, the spa cover crossbar having at least two crossbar portions telescopically connected to each other, the at least two crossbar portions slidable relative to each other from a first position in which the spa cover crossbar has a first length to a second position in which the spa cover crossbar has a second length, wherein the second length is greater than the first length, a first crossbar portion of the at least two crossbar portions having a bore to telescopically receive an end of a second crossbar portion of the at least two crossbar portions, the bore of the first crossbar portion having a bore cross-sectional shape;

the end of the second crossbar portion having a second crossbar portion end cross-sectional shape;

wherein when the end of the second crossbar portion is received by the bore of the first crossbar portion, the bore cross-sectional shape and the second crossbar portion end cross-sectional shape together inhibit rotation of the first crossbar portion relative to the second crossbar portion, wherein, the first and second lever arm joints respectively provide the first and second lever arms movability between a cover closed position, and a cover open position; and in the cover closed position each linear driver of the at least one linear driver is operable to urge the lever arm to move toward the cover open position.

15. The lift assembly of claim 14, wherein a smallest width dimension of the bore of the first crossbar portion is smaller than a largest width dimension of the end of the second crossbar portion.

16. The lift assembly of claim 14, wherein at least a portion of the second crossbar portion end cross-sectional shape is convexly curved.

17. The lift assembly of claim 16, wherein at least a portion of an outer surface of the first crossbar portion is convexly curved.

18. The lift assembly of claim 17, wherein at least a portion of the bore of the first crossbar portion is concave.

19. The lift assembly of claim 14, wherein the portion of the spa cover crossbar that has the cross-sectional shape defined at least in part by the convexly curved portion has an outer perimeter and at least 30% of the outer perimeter is formed by the convexly curved portion.

20. The lift assembly of claim 14, wherein the portion of the spa cover crossbar that has the cross-sectional shape defined at least in part by the convexly curved portion has a largest outer width and an outer perimeter of the curved portion has a radius of curvature that is between 35% and 75% of a magnitude of the largest outer width.

* * * * *